US009062666B2

(12) United States Patent
Ota et al.

(10) Patent No.: US 9,062,666 B2
(45) Date of Patent: Jun. 23, 2015

(54) SWASH PLATE TYPE VARIABLE DISPLACEMENT COMPRESSOR AND METHOD OF CONTROLLING SOLENOID THEREOF

(71) Applicant: KABUSHIKI KAISHA TOYOTA JIDOSHOKKI, Aichi-ken (JP)

(72) Inventors: Masaki Ota, Aichi-ken (JP); Shohei Fujiwara, Aichi-ken (JP); Takahiro Hoshida, Aichi-ken (JP); Hiroaki Kayukawa, Aichi-ken (JP); Noriyuki Shintoku, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 309 days.

(21) Appl. No.: 13/742,561

(22) Filed: Jan. 16, 2013

(65) Prior Publication Data

US 2013/0189121 A1 Jul. 25, 2013

(30) Foreign Application Priority Data

Jan. 19, 2012 (JP) ..... 2012-009309
Mar. 29, 2012 (JP) ..... 2012-077055

(51) Int. Cl.
*F04B 49/02* (2006.01)
*F04B 1/29* (2006.01)
*F04B 27/16* (2006.01)

(52) U.S. Cl.
CPC .. *F04B 1/29* (2013.01); *F04B 27/16* (2013.01)

(58) Field of Classification Search
CPC ..... F04B 27/14; F04B 27/16; F04B 27/18; F04B 27/1804
USPC ..... 417/222.2, 223; 92/70, 71
See application file for complete search history.

(56) References Cited

U.S. PATENT DOCUMENTS 4,393,966 A * 7/1983 Kono et al. ..... 192/56.41
4,701,109 A * 10/1987 Daikohara ..... 417/223
4,706,520 A 11/1987 Sivalingam
5,762,476 A * 6/1998 Ota et al. ..... 417/222.2

(Continued)

FOREIGN PATENT DOCUMENTS

CN 1590765 3/2005
JP 59-62326 4/1984

(Continued)

OTHER PUBLICATIONS

Chinese Office action having a mail date of Feb. 2, 2015.

*Primary Examiner* — Charles Freay
(74) *Attorney, Agent, or Firm* — Greenblum & Bernstein, P.L.C.

(57) ABSTRACT

The swash plate type variable displacement compressor includes a rotary shaft, a swash plate, a plurality of pistons, a first rotor, a second rotor, a solenoid and a cone clutch. The second rotor transmits the rotation of the first rotor to the swash plate. The solenoid produces electromagnetic force that acts on the first rotor or the second rotor so that the first rotor and the second rotor move toward each other. The cone clutch is engageable by energization of the solenoid. The cone clutch has a male cone portion and a female cone portion. The male cone portion has a conical surface provided on one of the first rotor and the second rotor. The female cone portion has a conical surface provided on the other. The conical surface of the female cone portion is connectable to and disconnectable from the conical surface of the male cone portion.

32 Claims, 34 Drawing Sheets

(56) References Cited

U.S. PATENT DOCUMENTS

| | | | | |
|---|---|---|---|---|
| 6,290,468 | B1 * | 9/2001 | Kato et al. | 417/222.2 |
| 6,318,971 | B1 * | 11/2001 | Ota et al. | 417/222.2 |
| 6,321,545 | B1 * | 11/2001 | Ota et al. | 62/133 |
| 2004/0184926 | A1 * | 9/2004 | Iwasa et al. | 417/223 |
| 2005/0058551 | A1 | 3/2005 | Wakita et al. | |
| 2008/0245637 | A1 | 10/2008 | Fetter et al. | |

FOREIGN PATENT DOCUMENTS

| | | |
|---|---|---|
| JP | 2005-82126 | 3/2005 |
| JP | 2006-17097 | 1/2006 |
| JP | 2006-152918 | 6/2006 |
| JP | 2007-24257 | 2/2007 |
| JP | 2008-256210 | 10/2008 |
| JP | 2011-241853 | 12/2011 |

* cited by examiner

SWASH PLATE TYPE VARIABLE DISPLACEMENT COMPRESSOR AND METHOD OF CONTROLLING SOLENOID THEREOF

BACKGROUND OF THE INVENTION

The present invention relates to a swash plate type variable displacement compressor including a rotary shaft, a swash plate and a plurality of pistons, wherein the swash plate is rotated by driving force of the rotary shaft, the swash plate being inclinable at a variable inclination angle, the pistons being engaged with the swash plate and reciprocable in accordance with the rotation of the swash plate so that the length of the stroke of each piston is varied depending on the inclination angle of the swash plate. The present invention also relates to a method of controlling a solenoid of the swash plate type variable displacement compressor.

In the swash plate type variable displacement compressor, when the swash plate is rotated by the rotation of the rotary shaft, the rotation of the swash plate is transmitted to the pistons via pairs of shoes thereby to cause the reciprocating motion of the pistons for compressing a refrigerant. When the inclination angle of the swash plate is changed with respect to the rotary shaft, the length of the stroke of each piston is changed thereby to vary the displacement of the swash plate type variable displacement compressor.

The swash plate type variable displacement compressor which is disclosed by Japanese Unexamined Patent Application Publication No. 2007-24257 has an electromagnetic clutch as the power transmission mechanism between the rotary shaft and the engine. The electromagnetic clutch is provided outside the compressor housing of the swash plate type variable displacement compressor. If the electromagnetic clutch is not used as the power transmission mechanism, power produced by the engine may be transmitted to the rotary shaft at all times. In such a swash plate type variable displacement compressor having no electromagnetic clutch, the engine rotates the rotary shaft constantly. In a vehicle air conditioner, therefore, when cooling operation is not needed, the displacement of the swash plate type variable displacement compressor is minimized by keeping the swash plate at the minimum inclination angle position. The minimization of the displacement reduces the load applied to the engine thereby to improve the fuel efficiency of the engine.

In the swash plate type variable displacement compressor with or without the electromagnetic clutch has pairs of shoes which are disposed in sliding contact with the swash plate. The sliding resistance between the shoes and the swash plate causes a mechanical loss, thereby providing the additional load applied to the engine. Particularly in a swash plate type variable displacement compressor having no clutch, the mechanical loss caused by the sliding resistance needs to be reduced in order to reduce the load applied to the engine when the compressor is operated at its minimum displacement (or with the swash plate placed at the minimum inclination angle position).

In the swash plate type variable displacement compressor which is disclosed by Japanese Unexamined Patent Application Publication No. 2006-152918, the swash plate is supported by its support that rotates integrally with the rotary shaft. The swash plate and the support are connectable to and disconnectable from each other via a clutch. The clutch is operable between a first state (or the engaged state) where the swash plate and the support are rotated integrally and a second state (or the disengaged state) where the swash plate is rotatable relative to the support. The spring force of a compression spring provided in the support and the centrifugal force acting on a spherical body provided between the swash plate and the support urge the swash plate in the direction that causes the power transmitting portion of the support and the power receiving portion of the swash plate to be disengaged from each other. By so constructing the compressor, shifting may be done between the first state of the clutch where the priority is given to the improvement of the displacement controllability when the swash plate is placed other than at the minimum inclination angle position, and the second state of the clutch where the priority is given to the reduction of the rotational resistance when the swash plate is placed at the minimum inclination angle position.

If the power transmitting portion of the support and the power receiving portion of the swash plate are disengaged from each other when the swash plate is placed at the minimum inclination angle position, the above-described problem raised by the swash plate type variable displacement compressor having no clutch is resolved. In the case of the swash plate type variable displacement compressor having the electromagnetic clutch, the disadvantage of a large power consumption due to energization of the electromagnetic clutch is also avoided.

However, the load that urges the swash plate toward the support when the swash plate is placed at the minimum inclination angle position depends on the rotational speed of the rotary shaft. The urging load is reduced and then increased with an increase of the rotational speed of the rotary shaft. For allowing the clutch to be shifted from the second state (or the disengaged state) where the swash plate and the support are disconnected from each other to the first state (or the engaged state) where the swash plate and the support are connected to each other, therefore, the spring load of the compression spring needs to be reduced approximately to the minimum value of the urging load. In the case of a relatively low rotational speed of the rotary shaft or a rotational speed of the compressor during the idling of a vehicle where the centrifugal force acting on the spherical body is relatively small, such a spring load of the compression spring cannot release the clutch from the engaged state, so that the mechanical loss incurred while the rotary shaft is rotating at a relatively low speed, e.g. idling operation of the engine, may not be reduced.

The present invention is directed to providing a swash plate type variable displacement compressor having an electromagnetic clutch that reduces the mechanical loss and the power consumption.

SUMMARY OF THE INVENTION

In accordance with a first aspect of the present invention, there is provided a swash plate type variable displacement compressor that includes a rotary shaft, a swash plate, a plurality of pistons, a first rotor, a second rotor, a solenoid and a cone clutch. The swash plate is rotated by driving force of the rotary shaft. The swash plate is inclinable at a variable inclination angle. The pistons are engaged with the swash plate and reciprocable in accordance with the rotation of the swash plate so that a length of stroke of each piston is varied depending on the inclination angle of the swash plate. The first rotor is connected to the rotary shaft for rotation therewith. The second rotor transmits the rotation of the first rotor to the swash plate. The solenoid produces electromagnetic force that acts on the first rotor or the second rotor so that the first rotor and the second rotor move toward each other. The cone clutch is engageable by energization of the solenoid. The cone clutch has a male cone portion and a female cone portion. The male cone portion has a conical surface provided on one of the first rotor and the second rotor. The female cone portion has a conical surface provided on the other of the first rotor and the second rotor. The conical surface of the female cone portion is connectable to and disconnectable from the conical surface of the male cone portion.

In accordance with a second aspect of the present invention, there is provided a method of controlling a solenoid of a swash plate type variable displacement compressor having a cone clutch engageable by energization of the solenoid. The method includes the steps of starting passing an electric current through the solenoid, detecting a differential pressure between a discharge pressure and a suction pressure after the step of starting passing the electric current through the solenoid, and stopping passing the electric current through the solenoid if the differential pressure reaches a preset differential-pressure reference value.

In accordance with a third aspect of the present invention, there is provided a method of controlling a solenoid of a swash plate type variable displacement compressor having a swash plate and a cone clutch. The swash plate is inclinable at a variable inclination angle. The cone clutch is engageable by energization of the solenoid. The method includes the steps of: detecting a first pressure of a refrigerant or a first pressure that reflects the first pressure of the refrigerant, when the swash plate is at a minimum inclination angle position; starting passing an electric current through the solenoid; detecting a second pressure of the refrigerant or a second element that reflects the second pressure of the refrigerant after the step of starting passing the electric current through the solenoid; and stopping passing the electric current through the solenoid if a value of change between the first pressure and the second pressure reaches a preset reference value or if a value of change between the first element and the second element reaches a preset reference value.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
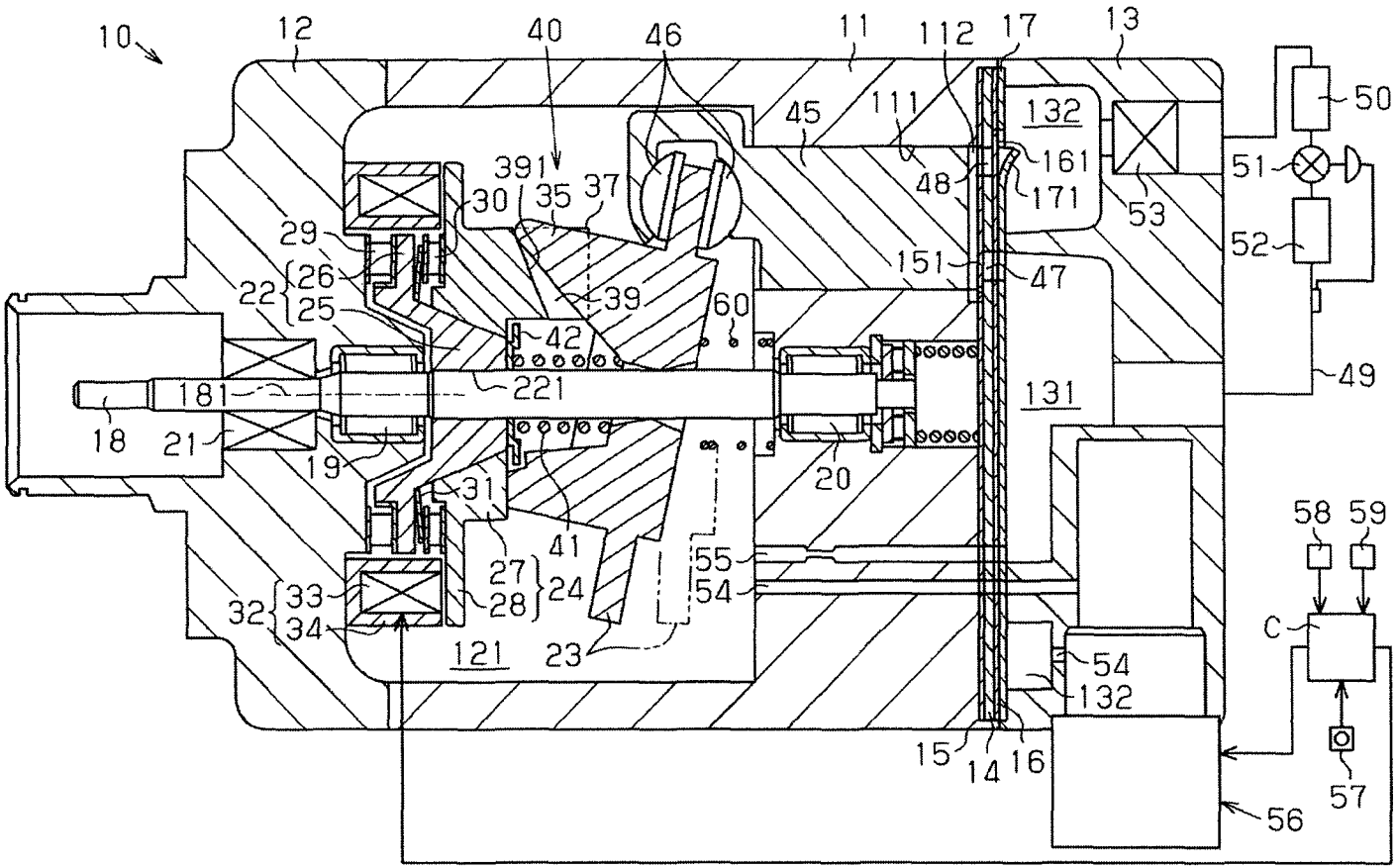
FIG. 1 is a longitudinal sectional view showing a variable displacement compressor according to a first embodiment of the present invention and its related devices.

The following will describe the first embodiment of the present invention with reference to FIGS. 1 through 5. Referring to FIG. 1 showing the variable displacement compressor in longitudinal sectional view, the variable displacement compressor is generally designated by reference numeral 10 and includes a cylinder block 11. The left-hand side and the right-hand side of the variable displacement compressor 10 as seen in FIG. 1 correspond to the front and the rear of the variable displacement compressor 10, respectively. A front housing 12 is joined to the cylinder block 11 at the front end thereof. A rear housing 13 is joined to the cylinder block 11 at the rear end thereof via a port plate 14, a suction valve plate 15, a discharge valve plate 16 and a retainer plate 17. The cylinder block 11, the front housing 12 and the rear housing 13 cooperate to form a compressor housing of the variable displacement compressor 10.

The front housing 12 and the cylinder block 11 cooperate to form a crank chamber 121 and rotatably support a rotary shaft 18 via radial bearings 19 and 20, respectively. The rotary shaft 18 extends forward of the crank chamber 121 for receiving driving force from a vehicle engine (not shown). A shaft seal device 21 of a lip seal type is interposed between the front housing 12 and the rotary shaft 18 for preventing refrigerant from leaking along the peripheral surface of the rotary shaft 18 out of the crank chamber 121.

A first rotor 22 is fixed on the rotary shaft 18 for rotation therewith. The first rotor 22 is formed in an annular shape to have an axial hole 221 through which the rotary shaft 18 is fixedly fitted. A swash plate 23 is supported on the rotary shaft 18 so as to be slidable along and inclinable with respect to the axis 181 of the rotary shaft 18. The swash plate 23 is disposed in the crank chamber 121. A second rotor 24 is interposed between the first rotor 22 and the swash plate 23.

The first rotor 22 has a male cone portion 25 fixed on the rotary shaft 18 and a pressure receiving portion 26 that extends radially outward from the outer periphery of the male cone portion 25. The pressure receiving portion 26 has a shape of an annular plate. The male cone portion 25 tapers toward the swash plate 23 and has a conical surface 251 that surrounds the axis 181 of the rotary shaft 18. The axis of the male cone portion 25 coincides with the axis 181.

The second rotor 24 has a female cone portion 27 that is connectable to and disconnectable from the male cone portion 25 of the first rotor 22, and an attraction receiving portion 28 that extends radially outward from the female cone portion 27 and has a shape of an annular plate. The outside diameter of the attraction receiving portion 28 of the second rotor 24 is made larger than that of the pressure receiving portion 26 of the first rotor 22. As viewed in the direction of the axis 181, the outer periphery of the pressure receiving portion 26 is located radially inward of the outer periphery of the attraction receiving portion 28.

The female cone portion 27 of the second rotor 24 tapers toward the swash plate 23 and has a conical surface 271 that surrounds the axis 181 of the rotary shaft 18. The axis of the female cone portion 27 coincides with the axis 181. The second rotor 24 is slidable along the rotary shaft 18 to move the conical surface 271 of the female cone portion 27 into and out of a joint contact with the conical surface 251 of the male cone portion 25. Thus, the male cone portion 25 and the female cone portion 27 cooperate to form a cone clutch K. The second rotor 24 is made of a magnetic material.

Figure 2:
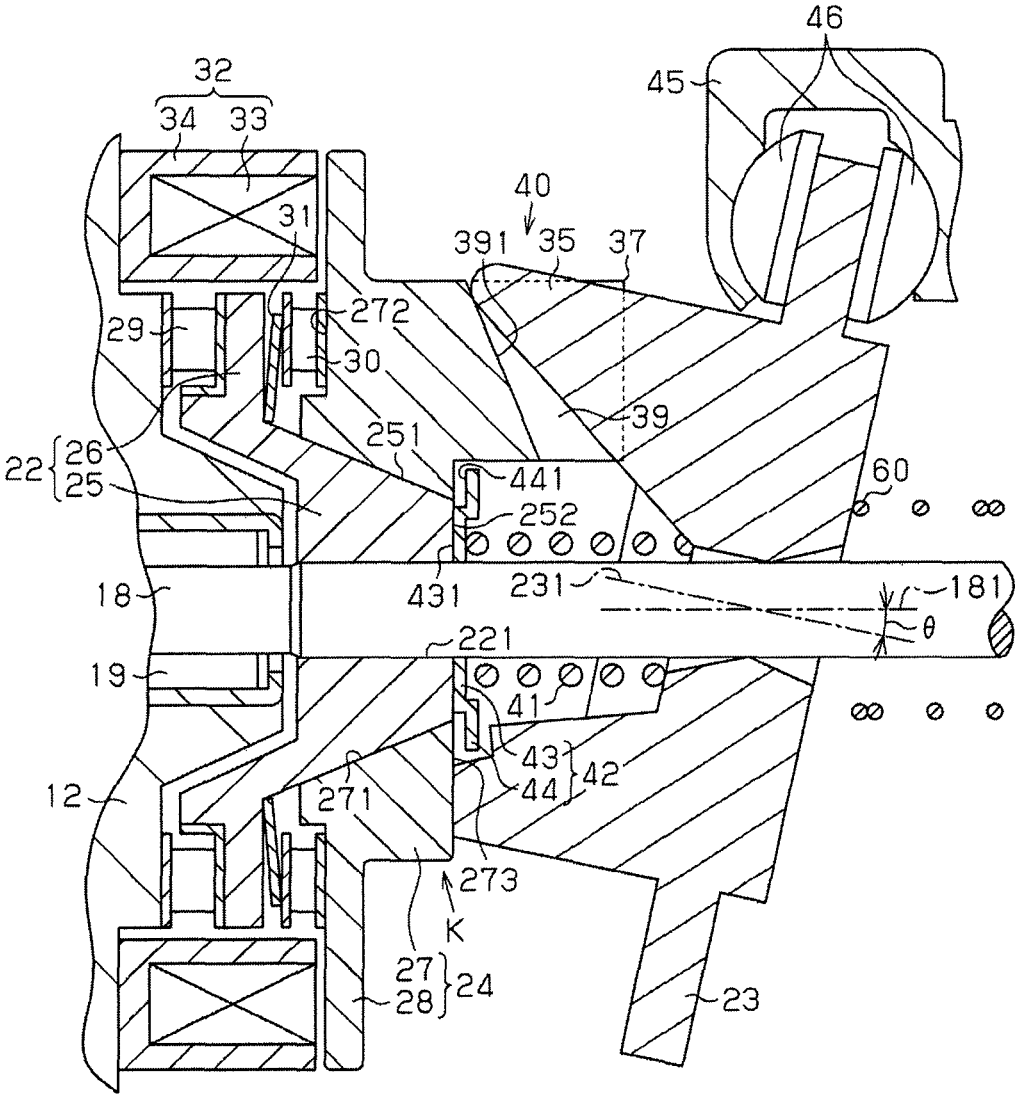
FIG. 2 is a partially enlarged sectional view of a swash plate of the variable displacement compressor of FIG. 1, showing a state where the swash plate is placed at the maximum inclination angle position.
Figure 3:
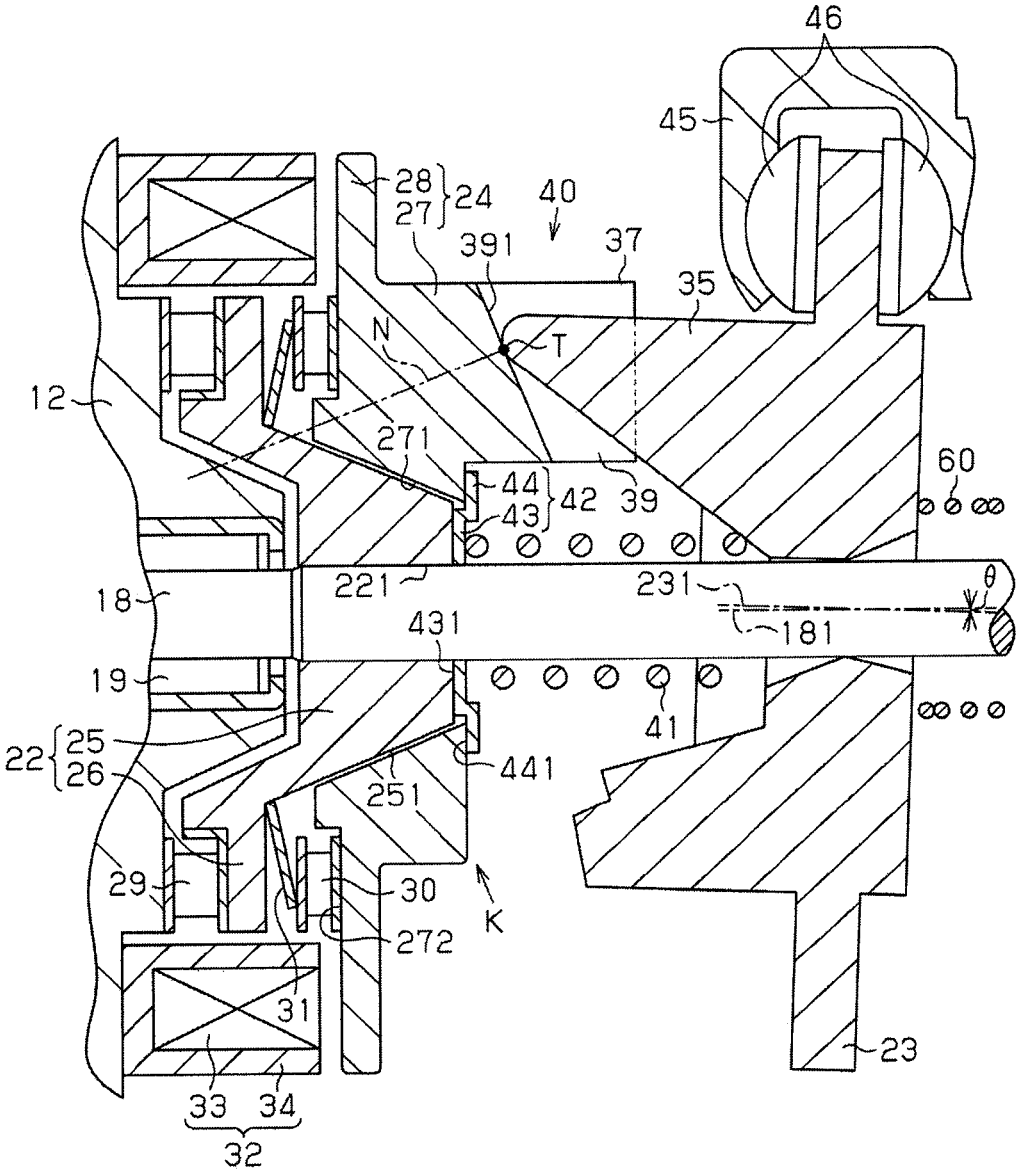
FIG. 3 is a partially enlarged sectional view of the swash plate of the variable displacement compressor of FIG. 1, showing a state where the swash plate is placed at the minimum inclination angle position.

Referring to FIGS. 2 and 3, a thrust bearing 29 is interposed between the pressure receiving portion 26 of the first rotor 22 and the front housing 12, and a thrust bearing 30 is interposed between the pressure receiving portion 26 and the female cone portion 27. The thrust bearing 30 is a rolling bearing. A disc spring 31 is interposed between the thrust bearing 30 and the pressure receiving portion 26 as a spring member that serves as a spacer. The thrust bearing 30 serves to reduce the sliding resistance between the disc spring 31 and the female cone portion 27. The disc spring 31 and the thrust bearing 30 are disposed surrounding the conical surface 251 of the male cone portion 25. The disc spring 31 presses the thrust bearing 30 against the surface 272 of the female cone portion 27 that faces the pressure receiving portion 26.

An annular solenoid 32 is mounted on the inner surface of the front housing 12 and disposed so as to surround the rotary shaft 18. The solenoid 32 has a coil 33 and a coil holder 34 that holds the coil 33. The coil holder 34 is made of a magnetic material and opened toward the attraction receiving portion 28 of the second rotor 24. When an electric current is passed through the coil 33, the attraction receiving portion 28 of the second rotor 24 receives attraction force (or electromagnetic force) produced by the solenoid 32. The solenoid 32, the first rotor 22 and the second rotor 24 cooperate to form an electromagnetic clutch that is incorporated in the compressor housing.

Figure 4:
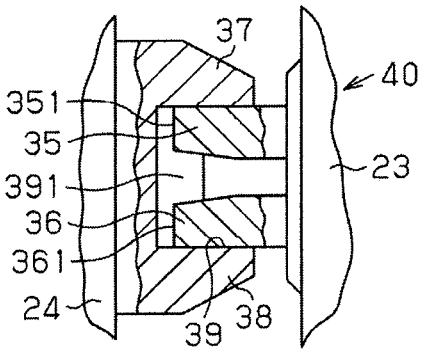
FIG. 4 is a partially enlarged sectional plan view showing a hinge mechanism of the variable displacement compressor of FIG. 1.

Referring to FIG. 4, a pair of projections 37 and 38 extends from the second rotor 24 toward the swash plate 23, and a pair of arms 35 and 36 extends from the swash plate 23 toward the second rotor 24. The paired arms 35 and 36 are inserted in a recess 39 formed between the paired projections 37 and 38. The paired arms 35 and 36 are sandwiched in between the paired projections 37 and 38 and movable in the recess 39. The innermost part of the recess 39 is formed as a cam surface 391 on which the distal ends 351 and 361 of the arms 35 and 36 are slidable. The paired arms 35 and 36 sandwiched in between the paired projections 37 and 38 work in cooperation with the cam surface 391 in such a way that the swash plate 23 is inclinable with respect to the axis 181 of the rotary shaft 18 and rotatable integrally with the rotary shaft 18. The paired arms 35, 36 and the paired projections 37, 38 cooperate to form a hinge mechanism 40 that allows the swash plate 23 to incline relative to the second rotor 24 and also allows torque transmission from the second rotor 24 to the swash plate 23.

As shown in FIGS. 2 and 3, θ represents an inclination angle of the swash plate 23 that is made between the central axis 231 of the swash plate 23 and the axis 181 of the rotary shaft 18. In the present embodiment, when the inclination angle θ of the swash plate 23 is minimum as shown in FIG. 3, the lines N (only one line being shown) that pass through the contact points T (only one contact point being shown) between the paired arms 35, 36 and the cam surface 391 and are normal to the cam surface 391 are set so as to extend inward of the inner peripheries of the thrust bearing 30 and the disc spring 31.

When the central part of the swash plate 23 is moved toward the second rotor 24 (or in forward direction), the inclination angle θ of the swash plate 23 increases. The maximum inclination angle of the swash plate 23 is determined by the contact between the second rotor 24 and the swash plate 23.

A return spring 60 is interposed between the swash plate 23 and the cylinder block 11 so as to surround the rotary shaft 18 for urging the swash plate 23 in the direction that causes the inclination angle θ of the swash plate 23 to be increased. The minimum inclination angle of the swash plate 23 is determined by the contact of the swash plate 23 with the front end of the return spring 60. The swash plate 23 shown in FIG. 1 (by the solid line) and FIG. 2 is placed at the maximum inclination angle position. The swash plate 23 shown in FIG. 1 (by the chain double-dashed line) and FIG. 3 is placed at the minimum inclination angle position. The minimum inclination angle of the swash plate 23 is set slightly larger than 0°.

As shown in FIG. 1, an inclination-angle reduction spring 41 is interposed between the male cone portion 25 of the first rotor 22 and the swash plate 23 so as to surround the rotary shaft 18. A stop 42 formed by an annular plain bearing is interposed between the inclination-angle reduction spring 41 and the male cone portion 25. The inclination-angle reduction spring 41 urges the swash plate 23 in the direction that causes the inclination angle θ of the swash plate 23 to be decreased.

The combined spring characteristics of the inclination-angle reduction spring 41 and the return spring 60 is set so that the swash plate 23 is placed at the minimum inclination angle position when the pressure in the variable displacement compressor 10 is uniform and the swash plate 23 is not rotated.

Figure 5:
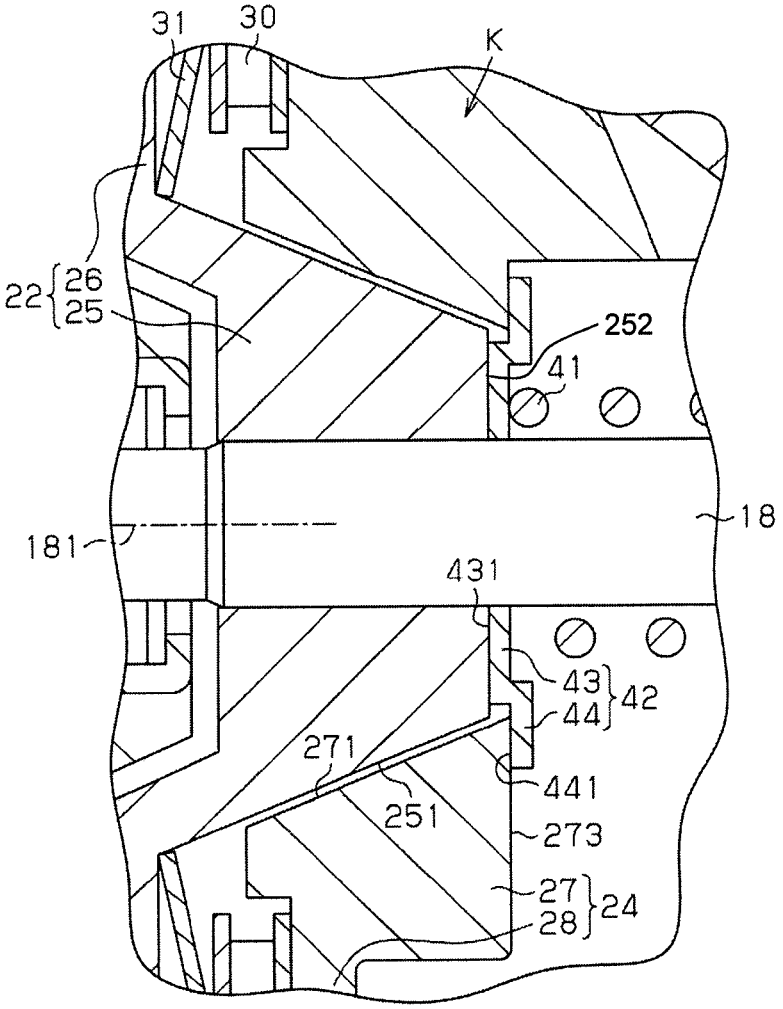
FIG. 5 is a partially enlarged sectional view showing a stop of the variable displacement compressor of FIG. 1.

Referring to FIG. 5, the stop 42 has an inner ring portion 43 and an outer ring portion 44. The inner ring portion 43 is in contact with the first rotor 22 and the inclination-angle reduction spring 41, and the outer ring portion 44 is connectable to and disconnectable from the second rotor 24, as seen from FIGS. 2 and 3. The front surface 431 of the inner ring portion 43 is pressed against the end surface 252 of the male cone portion 25 of the first rotor 22 by the spring force of the inclination-angle reduction spring 41. The front surface 441 of the outer ring portion 44 is located to face the end surface 273 of the female cone portion 27 of the second rotor 24. The front surface 441 of the outer ring portion 44 recedes from the front surface 431 of the inner ring portion 43 toward the swash plate 23. That is, the front surface 441 is spaced from the end surface 252 of the male cone portion 25 toward the swash plate 23.

Referring back to FIG. 1, the cylinder block 11 has therethrough a plurality of cylinder bores 111 each receiving therein a piston 45. Each piston 45 is engaged with the outer periphery of the swash plate 23 via a pair of shoes 46. Rotation of the swash plate 23 is converted into the reciprocating motion of the pistons 45 via the pairs of shoes 46. Thus, the pistons 45 are reciprocable in the respective cylinder bores 111. The length of the stroke of each piston 45 moving its cylinder bore 111 is variable depending on the inclination angle of the swash plate 23.

The rear housing 13 has therein a suction chamber 131 and a discharge chamber 132 that form a suction pressure region and a discharge pressure region of the compressor 10, respectively. Each of the port plate 14, the discharge valve plate 16 and the retainer plate 17 has therethrough a plurality of suction ports 47. Each of the port plate 14 and the suction valve plate 15 has therethrough a plurality of discharge ports 48. The suction valve plate 15 has a plurality of suction valves 151, and the discharge valve plate 16 has a plurality of discharge valves 161. A compression chamber 112 is formed in each cylinder bore 111 between the suction valve plate 15 and the piston 45 in the cylinder bore 111.

When the piston 45 is moved forward (or moved leftward as seen in FIG. 1), refrigerant in the suction chamber 131 flows into its compression chamber 112 while pushing away the suction valve 151 thereby to open the suction port 47. When the piston 45 is moved rearward (or moved rightward as seen in FIG. 1), the refrigerant is compressed in the compression chamber 112 and discharged into the discharge chamber 132 while pushing away the discharge valve 161 thereby to open the discharge port 48. The opening of the discharge valve 161 is restricted by the contact of the discharge valve 161 with the retainer 171 formed on the retainer plate 17.

When the pressure in the crank chamber 121 decreases, the inclination angle of the swash plate 23 is increased to increase the displacement of the variable displacement compressor 10. When the pressure in the crank chamber 121 increases, on the other hand, the inclination angle of the swash plate 23 is decreased to decrease the displacement of the variable displacement compressor 10. The suction chamber 131 and the discharge chamber 132 are connected via an external refrigerant circuit 49 that includes a condenser 50, an expansion valve 51 and an evaporator 52. The condenser 50 absorbs heat from the refrigerant flowing therethrough, and the evaporator 52 transfers the surrounding heat to the refrigerant flowing in the evaporator 52. A check valve 53 is located between the discharge chamber 132 and the external refrigerant circuit 49. The refrigerant in the discharge chamber 132 flows through the check valve 53 into the external refrigerant circuit 49.

The reaction force developed when the refrigerant is discharged from the compression chamber 112 is received by the front housing 12 via the cylinder bore 111, the piston 45, the pair of shoes 46, the swash plate 23, the hinge mechanism 40, the second rotor 24, the cone clutch K, the first rotor 22 and the thrust bearing 29.

The discharge chamber 132 and the crank chamber 121 are connected via a supply passage 54. The crank chamber 121 and the suction chamber 131 are connected via a bleed passage 55. An electromagnetically-operated displacement control valve 56 is connected in the supply passage 54. A control computer C is connected to the displacement control valve 56 for controlling passage of an electric current with duty ratio through the displacement control valve 56. The control computer C is connected to an air-conditioner operation switch 57. The control computer C passes an electric current through the displacement control valve 56 when the air-conditioner operation switch 57 is ON. The control computer C stops passing the electric current through the displacement control valve 56 when the air-conditioner operation switch 57 is OFF. A room temperature setting device 58 and a room temperature sensor 59 are connected to the control computer C by signals. When the air-conditioner operation switch 57 is ON, the control computer C controls passage of the electric current through the displacement control valve 56 in accordance with the difference between a target room temperature set by the room temperature setting device 58 and a room temperature sensed by the room temperature sensor 59. The opening of the displacement control valve 56 decreases as the duty ratio increases.

The following will describe the operation of the first embodiment. When the swash plate 23 is placed at the minimum inclination angle position and the cone clutch K is disengaged, as shown in FIG. 3, the passage of the electric current through the displacement control valve 56 is stopped and the opening of the displacement control valve 56 is maximum. When the swash plate 23 is placed at the minimum inclination angle position, there is slight differential pressure between the compression chambers 112 and the crank chamber 121, so that the reaction force received by the swash plate 23 due to the differential pressure is relatively small. Therefore, the second rotor 24 is located in the position where the female cone portion 27 is in contact with the stop 42 by the spring force of the disc spring 31.

When the passage of the electric current through the displacement control valve 56 is started, energization of the solenoid 32 is also started. When the energization of the solenoid 32 is started, the attraction receiving portion 28 of the second rotor 24 is attracted toward the solenoid 32 against the spring force of the disc spring 31, so that the conical surface 271 of the female cone portion 27 comes in contact with the conical surface 251 of the male cone portion 25. That is, the cone clutch K is shifted from the disengaged state to the engaged state. When the cone clutch K is engaged, the rotation of the first rotor 22 is transmitted to the second rotor 24 via the cone clutch K thereby to rotate the second rotor 24 and the swash plate 23 integrally with the first rotor 22. Energization of the solenoid 32 is stopped when it is considered that a time taken to shift the cone clutch K from the disengaged state to the engaged state has passed since the start of the energization of the solenoid 32.

When the passage of the electric current through the displacement control valve 56 is started, the opening of the displacement control valve 56 decreases. In this case, the cone clutch K is engaged thereby to rotate the swash plate 23, so that the refrigerant is discharged from the compression chambers 112 into the discharge chamber 132. Thus, the inclination angle of the swash plate 23 increases. With an increase of the inclination angle of the swash plate 23 from the minimum inclination angle, the discharge pressure also increases. When the discharge pressure increases, the check valve 53 is opened thereby to allow the refrigerant in the discharge chamber 132 to flow into the external refrigerant circuit 49. The refrigerant flowed into the external refrigerant circuit 49 returns to the suction chamber 131.

When the current value supplied to the displacement control valve 56 is increased, the opening of the displacement control valve 56 is decreased thereby to decrease the refrigerant supplied from the discharge chamber 132 to the crank chamber 121. Since part of the refrigerant in the crank chamber 121 flows into the suction chamber 131 via the bleed passage 55, the pressure in the crank chamber 121 decreases with a decrease of the supply of the refrigerant, so that the inclination angle of the swash plate 23 is increased and hence the displacement of variable displacement compressor 10 is increased. When the current value supplied to the displacement control valve 56 is decreased, on the other hand, the opening of the displacement control valve 56 is increased thereby to increase the refrigerant supplied from the discharge chamber 132 into the crank chamber 121. Therefore, the pressure in the crank chamber 121 increases, so that the inclination angle of the swash plate 23 is decreased and hence the displacement of variable displacement compressor 10 is decreased.

When the duty ratio becomes zero, or when the energization of the displacement control valve 56 is stopped, the opening of the displacement control valve 56 becomes maximum. The second rotor 24 and the swash plate 23 are then located in the position shown in FIG. 3 by the spring force of the disc spring 31. When the swash plate 23 stops rotating, the check valve 53 is closed thereby to stop the refrigerant from flowing through the external refrigerant circuit 49.

The following will describe the advantageous effects of the first embodiment.

(1) The electromagnetic clutch including the solenoid 32 and the cone clutch K is disengaged when the inclination angle of the swash plate 23 is minimum, so that the second rotor 24 is then disconnected from the first rotor 22. With the swash plate 23 placed at the minimum inclination angle position, therefore, the swash plate 23 is free from integral rotation with the second rotor 24. Thus, mechanical loss of the variable displacement compressor 10 is reduced.

(2) While the inclination angle of the swash plate 23 is increased from the disengaged state of the cone clutch K, the electromagnetic clutch is engaged temporarily. When the electromagnetic clutch is engaged, the first rotor 22 and the second rotor 24 are rotated integrally thereby to rotate the swash plate 23 with the second rotor 24 integrally. The inclination angle of the swash plate 23 is increased and the reaction force developed due to the discharging of refrigerant is also increased, so that the engaged state of the cone clutch K is kept though the energization of the solenoid 32 is then stopped. Since the electromagnetic clutch is engaged only temporarily, the power consumption of the compressor 10 is reduced extremely.

(3) The first rotor 22 is located radially inward of the annular solenoid 32 as viewed in the direction of the axis 181 of the rotary shaft 18. The structure wherein the inside diameter of the solenoid 32 is made larger than the outside diameter of the first rotor 22 is advantageous in that the diameter of the solenoid 32 is increased thereby to enhance the electromagnetic force.

(4) If the attraction receiving portion 28 of the second rotor 24 is spaced too far from the solenoid 32, the electromagnetic force of the solenoid 32 acting on the attraction receiving portion 28 is reduced, which makes it difficult to engage the cone clutch K. The stop 42 regulates the distance in the direction of the axis 181 between the solenoid 32 and the attraction receiving portion 28, or the distance in the direction of the axis 181 between the first rotor 22 and the second rotor 24, in such a way that the electromagnetic force of the solenoid 32 has a magnitude that is strong enough for the attraction receiving portion 28 to be attracted to the solenoid 32.

(5) The inclination-angle reduction spring 41 is simple in structure, but effective to hold the stop 42 in place.

(6) When the inclination angle of the swash plate 23 is minimum, the end surface 273 of the female cone portion 27 of the second rotor 24 is in contact with the outer ring portion 44 of the stop 42. The stop 42 formed by the plain bearing prevents the second rotor 24 from rotating with the swash plate 23 when the swash plate 23 is placed at the minimum inclination angle position.

(7) When the swash plate 23 is placed into the minimum inclination angle position, the spring force of the disc spring 31 causes the conical surfaces 251 and 271 of the first and second rotors 22 and 24 to be spaced from each other thereby to shift the cone clutch K from the engaged state to the disengaged state. When the swash plate 23 is at the minimum inclination angle position, therefore, the second rotor 24 becomes free from rotation with the first rotor 22. In order to shift the cone clutch K from the disengaged state to the engaged state, the electromagnetic force of the solenoid 32 acting on the attraction receiving portion 28 of the disengaged cone clutch K should be strong enough, or, alternatively, the distance in the direction of the axis 181 between the solenoid 32 and the attraction receiving portion 28 may be reduced. In order to shift the cone clutch K from the engaged state to the disengaged state, on the other hand, the force that pulls the conical surfaces 251 and 271 away from each other should be strong enough.

The use of the disc spring 31 having a small amount of elastic deformation is advantageous in that the distance in the direction of the axis 181 between the solenoid 32 and the attraction receiving portion 28 may be reduced when the cone clutch K is disengaged and also that the spring force may be increased when the cone clutch K is engaged.

(8) While the cone clutch K is disengaged, there is fear that the second rotor 24 may be inclined by the arms 35 and 36 then pressing against the cam surface 391. More specifically, the second rotor 24 may be inclined in the direction that causes the arms 35 and 36 to be moved toward the solenoid 32, or in the direction that causes the upper side of the attraction receiving portion 28 of the second rotor 24 to be moved toward the solenoid 32 as seen in FIG. 3. Such an inclination may cause the contact between the solenoid 32 and the attraction receiving portion 28, which produces abrasion powder in a region of the contact.

It is so set that when the swash plate 23 is placed at the minimum inclination angle position, the normal lines N (only one line being shown) to the cam surface 391 at the contact points T (only one point being shown) between the paired arms 35, 36 and the cam surface 391 pass inward of the inner peripheries of the thrust bearing 30 and the disc spring 31. Such setting prevents the inclination of the second rotor 24 caused by pressing of the arms 35 and 36 against the cam surface 391.

Figure 6:
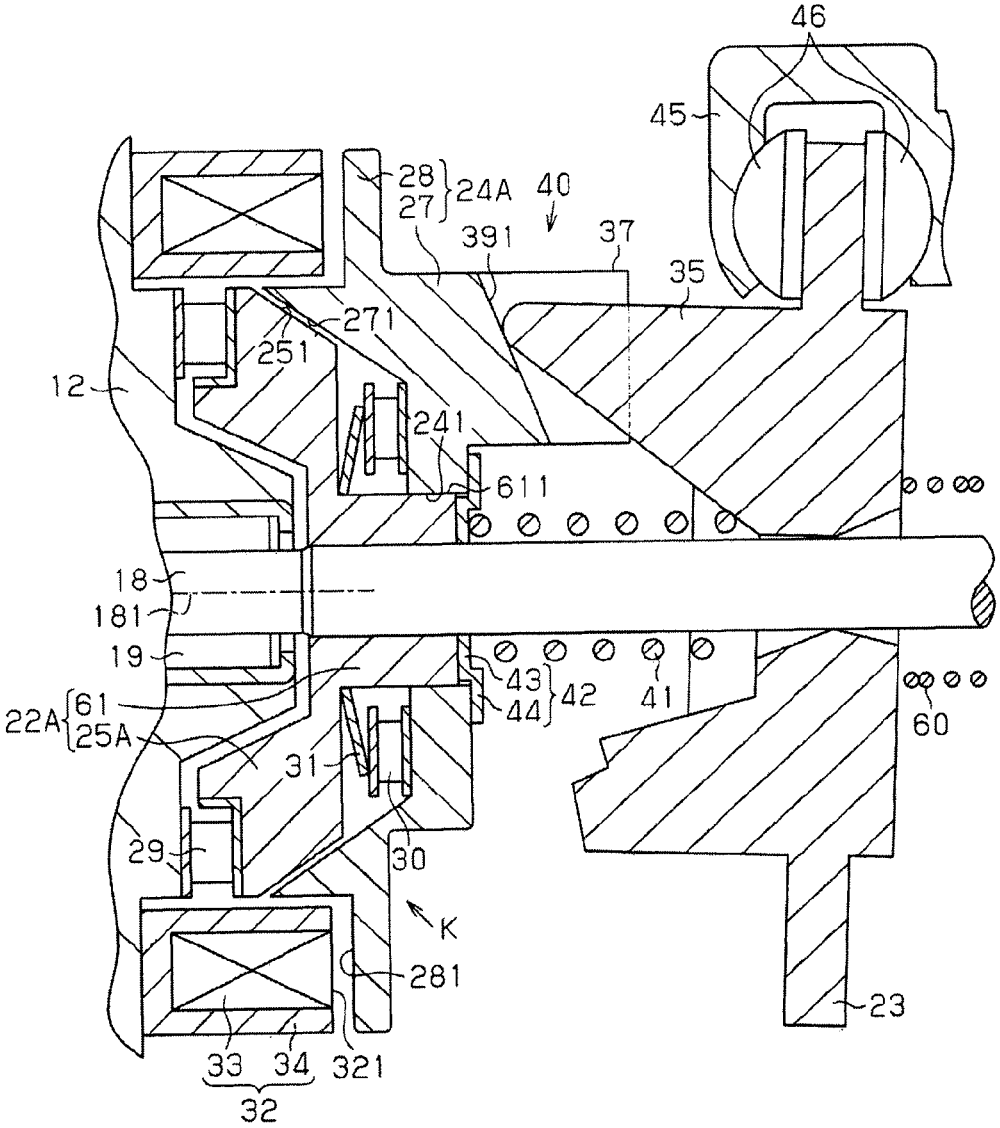
FIG. 6 is a partially enlarged sectional view of a swash plate of a variable displacement compressor according to a second embodiment of the present invention, showing a state where the swash plate is placed at the minimum inclination angle position.

The following will describe the second embodiment of the present invention with reference to FIG. 6. The same reference numerals are used for the common elements or components in the first and second embodiments, and the description of such elements or components for the second embodiment will be omitted.

Referring to FIG. 6, the first rotor 22A corresponding to the first rotor 22 of the first embodiment has a cylindrical guide portion 61 and a male cone portion 25A that is located radially outward of the cylindrical guide portion 61 and serves as a pressure receiving portion. The cylindrical guide portion 61 is fixed on the rotary shaft 18. The disc spring 31 and the thrust bearing 30 are disposed surrounding the cylindrical guide portion 61.

The second rotor 24A corresponding to the second rotor 24 of the first embodiment receives therein the cylindrical guide portion 61 of the first rotor 22A so as to be rotatable relative to and slidable on the cylindrical guide portion 61. The conical surface 271 of the female cone portion 27 of the second rotor 24A surrounds the disc spring 31 and the thrust bearing 30. The second rotor 24A has a radially inner peripheral surface 241 that serves as a cylindrical surface. The inner peripheral surface 241 and a radially outer peripheral surface 611 of the cylindrical guide portion 61 are in contact with each other. When the solenoid 32 is energized with the swash plate 23 placed at the minimum inclination angle position, the second rotor 24A is moved in the direction of the axis 181 while being guided by the outer peripheral surface 611 of the cylindrical guide portion 61. The cylindrical guide portion 61 and the inner peripheral surface 241 cooperate to form a guide that guides the second rotor 24A so as to be rotatable relative to and slidable on the cylindrical guide portion 61.

In the second embodiment, the same advantageous effects as those in the first embodiment are obtained and the following additional effects are also obtained. In the first embodiment, when the cone clutch K is shifted from the disengaged state to the engaged state, the second rotor 24 may be inclined relative to the axis 181. If the second rotor 24 is thus inclined, the surface 281 of the attraction receiving portion 28 of the second rotor 24 that faces the solenoid 32 is not kept parallel to the attraction surface 321 of the solenoid 32, so that the electromagnetic force of the solenoid 32 fails to act on the attraction receiving portion 28 of the second rotor 24 along the circumference of the attraction receiving portion 28 uniformly. This causes the cone clutch K to be displaced from the disengaged state to the engaged state with the second rotor 24 inclined relative to the axis 181. Thus, the attraction receiving portion 28 of the second rotor 24 may come into contact with the solenoid 32, which produces abrasion powder in the region of contact between the non-rotating solenoid 32 and the rotating second rotor 24.

In the second embodiment, the second rotor 24A which is constantly supported by the cylindrical guide portion 61 of the first rotor 22A will not be inclined relative to the axis 181. Therefore, the compressor 10 according to the second embodiment is free from the problem associated with the abrasion powder caused by the inclination of the second rotor 24A.

Figure 7:
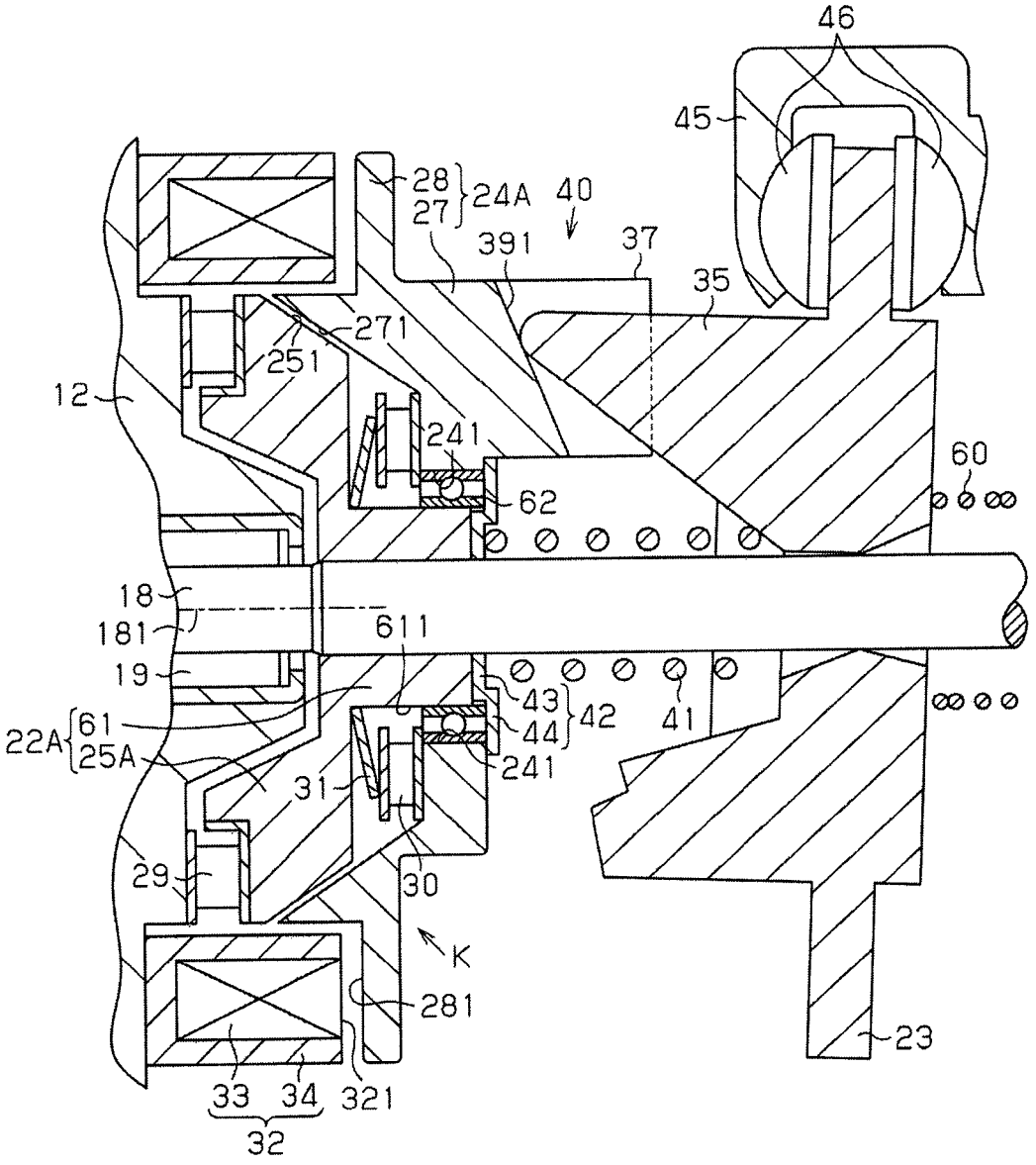
FIG. 7 is a partially enlarged sectional view of a swash plate of a variable displacement compressor according to a third embodiment of the present invention, showing a state where the swash plate is placed at the minimum inclination angle position.

The following will describe the third embodiment of the present invention with reference to FIG. 7. The same reference numerals are used for the common elements or components in the second and third embodiments, and the description of such elements or components for the third embodiment will be omitted.

Referring to FIG. 7, a rolling bearing 62 is interposed as a radial bearing between the outer peripheral surface 611 of the cylindrical guide portion 61 and the inner peripheral surface 241 of the second rotor 24A. The rolling bearing 62 serves to smoothen the relative rotation and sliding motion between the first rotor 22A and the second rotor 24A.

Figure 8:
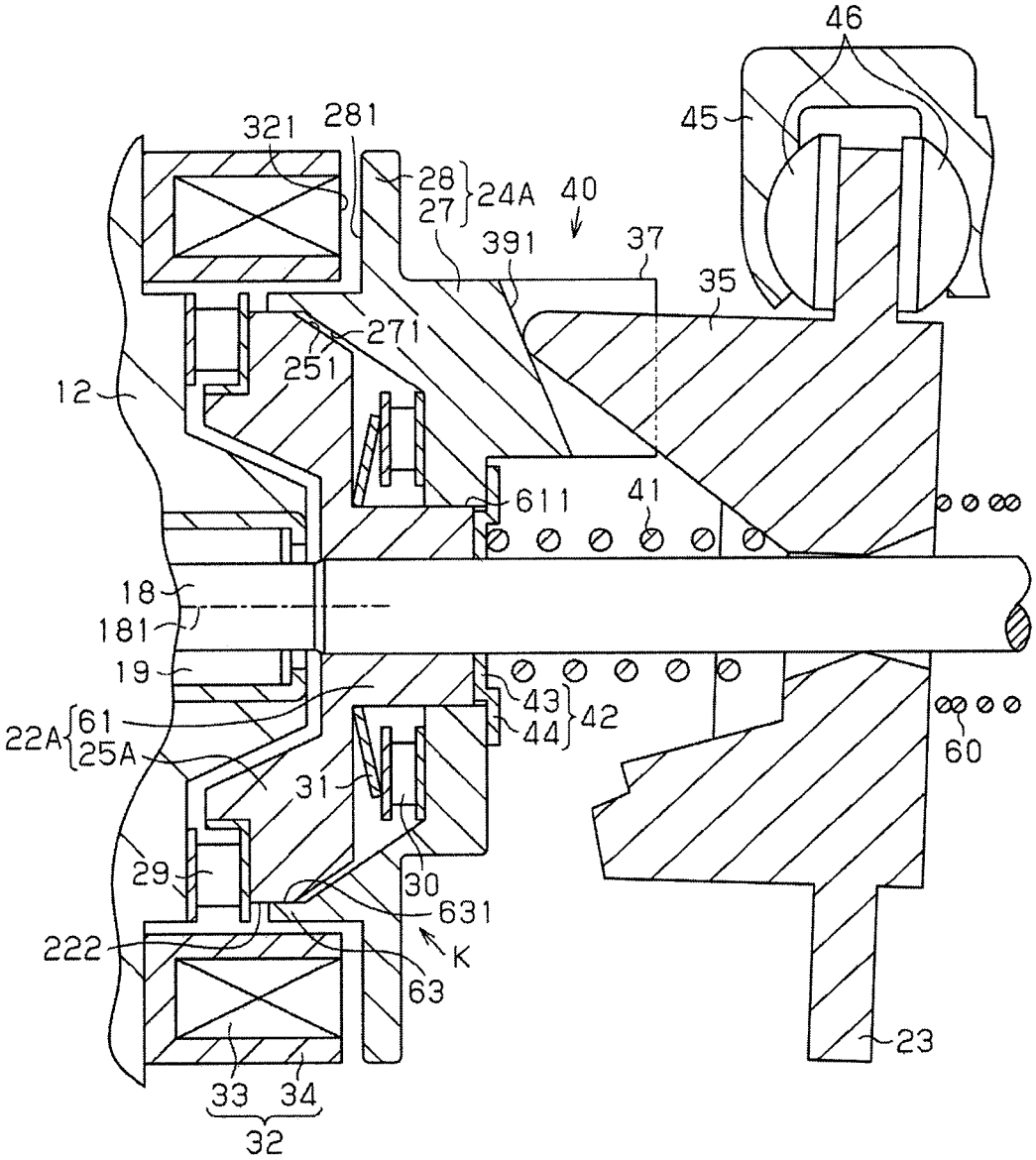
FIG. 8 is a partially enlarged sectional view of a swash plate of a variable displacement compressor according to a fourth embodiment of the present invention, showing a state where the swash plate is placed at the minimum inclination angle position.

The following will describe the fourth embodiment of the present invention with reference to FIG. 8. The same reference numerals are used for the common elements or components in the second and fourth embodiments, and the description of such elements or components for the fourth embodiment will be omitted.

Referring to FIG. 8, a second rotor 24A has a cylindrical guide portion 63 at a position that is radially outward of the male cone portion 25A and surrounds the first rotor 22A. The first rotor 22A is fitted in the cylindrical guide portion 63 of the second rotor 24A. The first rotor 22 has a radially outer peripheral surface 222 of the first rotor 22A that serves as a cylindrical surface. The outer peripheral surface 222 and a radially inner peripheral surface 631 of the cylindrical guide portion 63 of the second rotor 24A are in contact with each other. The cylindrical guide portion 63 and the outer peripheral surface 222 cooperate to form a guide that guides the second rotor 24A rotatably and slidably relative to the male cone portion 25A.

Although the cylindrical guide portion 63 plays a role that is similar to the cylindrical guide portion 61, the cylindrical guide portion 63 having a larger inside diameter than the outside diameter of the cylindrical guide portion 61 is more effective in preventing the inclination of the second rotor 24A than the cylindrical guide portion 61 in the second embodiment. The structure wherein the second rotor 24A is guided at the peripheral surfaces 241 and 631 is particularly effective in preventing the inclination of the second rotor 24A and also in smoothening the sliding motion of the second rotor 24A.

Figure 9:
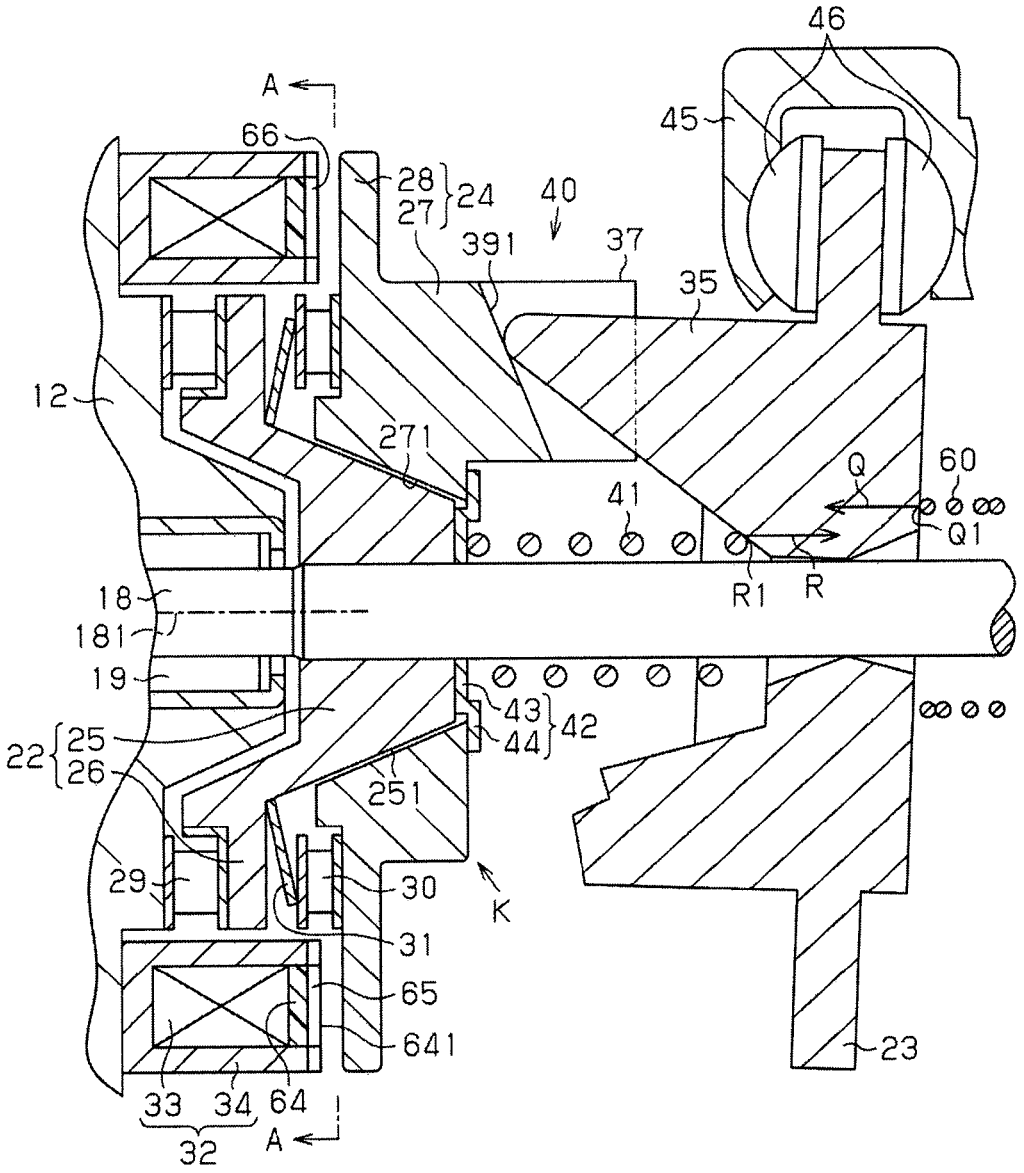
FIG. 9 is a partially enlarged sectional view of a swash plate of a variable displacement compressor according to a fifth embodiment of the present invention, showing a state where the swash plate is placed at the minimum inclination angle position.
Figure 10:
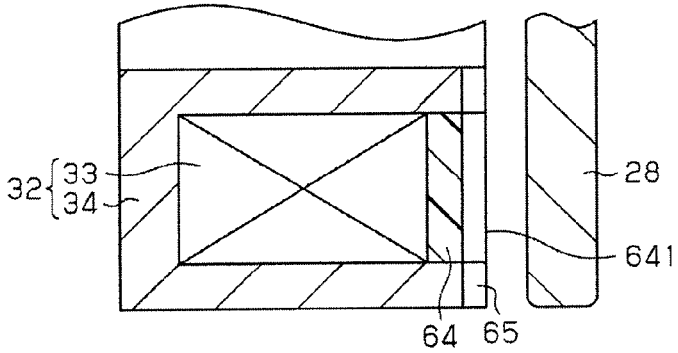
FIG. 10 is a partially enlarged view showing a first lubrication groove of the variable displacement compressor of FIG. 9.
Figure 11:
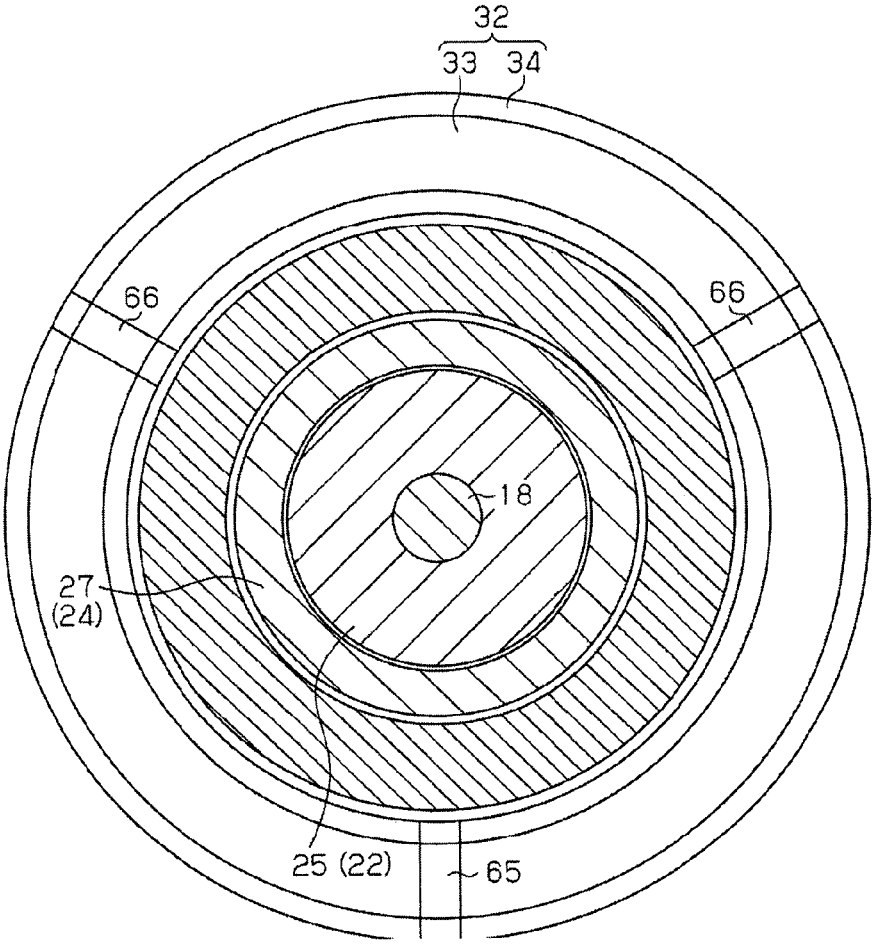
FIG. 11 is a cross sectional view showing the variable displacement compressor as taken along the line A-A of FIG. 9.

The following will describe the fifth embodiment of the present invention with reference to FIGS. 9 through 11. The same reference numerals are used for the common elements or components in the first and fifth embodiments, and the description of such elements or components for the fifth embodiment will be omitted.

Referring to FIGS. 9 and 10, an annular coil cover 64 is provided on the surface of the coil 33 that faces the attraction receiving portion 28 of the second rotor 24 (or in the opening of the coil holder 34). The coil cover 64 is made of a resin for sealing the coil 33 in the coil holder 34.

Referring to FIGS. 9 and 11, one first lubrication groove 65 and two second lubrication grooves 66 are formed radially in the surface of the coil cover 64 and the annular surface 641 of the coil holder 34 that face the attraction receiving portion 28. The first lubrication groove 65 is located below the axis 181 and the second lubrication grooves 66 are located above the axis 181. Specifically, the first lubrication groove 65 is located at the bottom of the coil cover 64. The first lubrication groove 65 and the second lubrication grooves 66 are formed radially across the coil cover 64 and the annular surface 641 of the coil holder 34. The second lubrication groove 66 communicates at the inner periphery of the annular surface 641 with the radially inner region of the solenoid 32.

When the swash plate 23 is placed at the minimum inclination angle position, lubricating oil is accumulated in the bottom of the crank chamber 121 and flows into the first lubrication groove 65. While the cone clutch K is in the disengaged state, the male cone portion 25 and the female cone portion 27 may come in contact with the each other occasionally, so that the second rotor 24 is rotated with the first rotor 22. Such rotation of the second rotor 24 with the first rotor 22 causes the lubricating oil in the first lubrication groove 65 to be pulled up as oil film through the space between the coil cover 64 and the attraction receiving portion 28.

In order to pull up the lubricating oil, it is necessary to rotate the second rotor 24 with the first rotor 22. In the present embodiment, the diameter of the return spring 60 is made larger than that of the inclination-angle reduction spring 41 as shown in FIG. 9. That is, the point of action of the return spring 60 that acts on the swash plate 23 (or the starting point Q1 of the arrow Q that represents the direction of action) is located radially outward of the point of action of the inclination-angle reduction spring 41 on the swash plate 23 (or the starting point R1 of the arrow R that represents the direction of action). In this structure, the swash plate 23 at the minimum inclination angle position is subjected to a force acting in a counterclockwise direction as seen in FIG. 9 by the action of the return spring 60 and the action of the inclination-angle reduction spring 41, so that the cam surface 391 is pressed by the arms 35 and 36. The actions of the arms 35 and 36 pressing against the cam surface 391 increase the tendency of the conical surfaces 271 and 251 to contact with each other and hence the tendency of the second rotor 24 to be rotated with the first rotor 22 is enhanced.

A part of the lubricating oil pulled up is flowed into the second lubrication grooves 66 and then supplied to the thrust bearing 30 that is located radially inward of the solenoid 32.

A part of the lubricating oil that is attached to a rotary member, such as the first rotor 22, the disc spring 31 or the thrust bearing 30, flows along the inner peripheral surface of the solenoid 32 into the space between the first rotor 22 and the front housing 12 by centrifugal force. The thrust bearing 29, the radial bearing 19 and the shaft seal device 21 are lubricated by the lubricating oil flowed into the space between the first rotor 22 and the front housing 12.

When the swash plate 23 is placed at the minimum inclination angle position, the rotary shaft 18 and the first rotor 22 are rotated and hence the thrust bearing 29, the radial bearing 19 and the shaft seal device 21 need to be lubricated. The lubricating oil in the first lubrication groove 65 and the second lubrication groove 66 is supplied to the thrust bearing 29, the radial bearing 19 and the shaft seal device 21 for lubrication thereof. Thus, the thrust bearing 29, the radial bearing 19 and the shaft seal device 21 are lubricated appropriately when the swash plate 23 is placed at the minimum inclination angle position.

In the structure according to the fifth embodiment, the first lubrication groove 65 located at the bottom of the coil cover 64 is likely to be immersed in the lubricating oil accumulated in the bottom of the crank chamber 121. That is, the present embodiment wherein the first lubrication groove 65 is located at the bottom of the coil cover 64 is effective in pulling the lubricating oil into the first lubrication groove 65.

Figure 13:
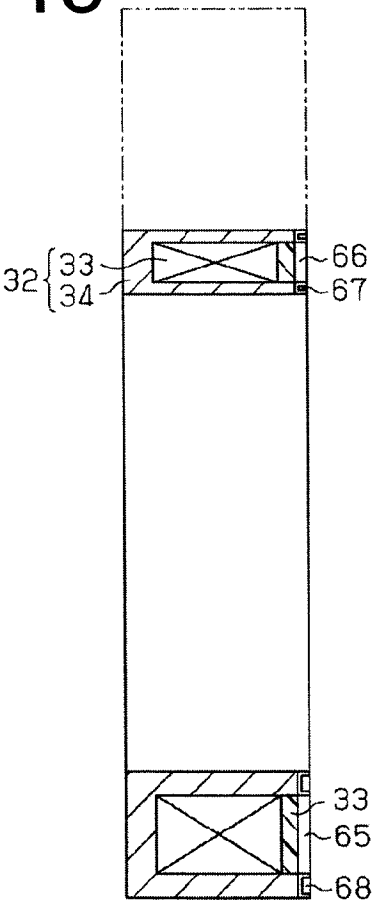
FIG. 13 is a sectional view showing the variable displacement compressor as taken along the line B-B of FIG. 12.
Figure 12:
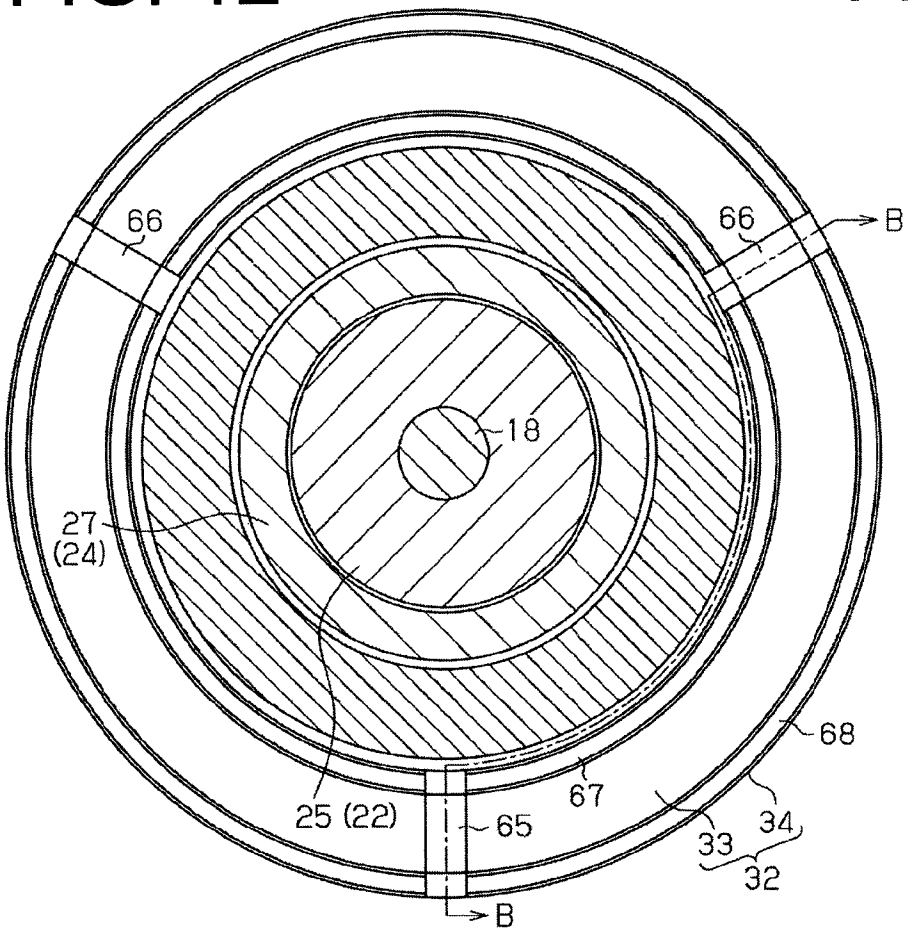
FIG. 12 is a cross sectional view similar to FIG. 11, but showing a variable displacement compressor according to a sixth embodiment of the present invention.

The following will describe the sixth embodiment of the present invention with reference to FIGS. 12 and 13. The same reference numerals are used for the common elements or components in the fifth and sixth embodiments, and the description of such elements or components for the sixth embodiment will be omitted.

Referring to FIGS. 12 and 13, a first annular lubrication groove 67 and a second annular lubrication groove 68 are formed in the annular surface 641 of the coil holder 34 at positions that are radially inward and outward of the annular surface 641, respectively, so as to extend along the circumferential direction of the coil cover 64. The first annular lubrication groove 67 is located radially inward of the second annular lubrication groove 68. The first lubrication groove 65 and the second lubrication grooves 66 are formed radially across the first annular lubrication groove 67 and the second annular lubrication groove 68. Each of the first lubrication groove 65 and the second lubrication grooves 66 communicates at the inner periphery of the coil holder 34 with the radially inner region of the solenoid 32 and at the outer periphery of the coil holder 34 with the radially outer region of the solenoid 32. The first lubrication groove 65 and the second lubrication grooves 66 are connected to the first annular lubrication groove 67 and the second annular lubrication groove 68.

The first annular lubrication groove 67 and the second annular lubrication groove 68 serve to prevent the lubricating oil that is pulled upward from the lower part of the solenoid 32 from leaking radially outward due to the centrifugal force, thereby guiding the lubricating oil toward the upper part of the solenoid 32 and lubricating the thrust bearings 30, 29, the radial bearing 19 and the shaft seal device 21 successfully.

Figure 14:
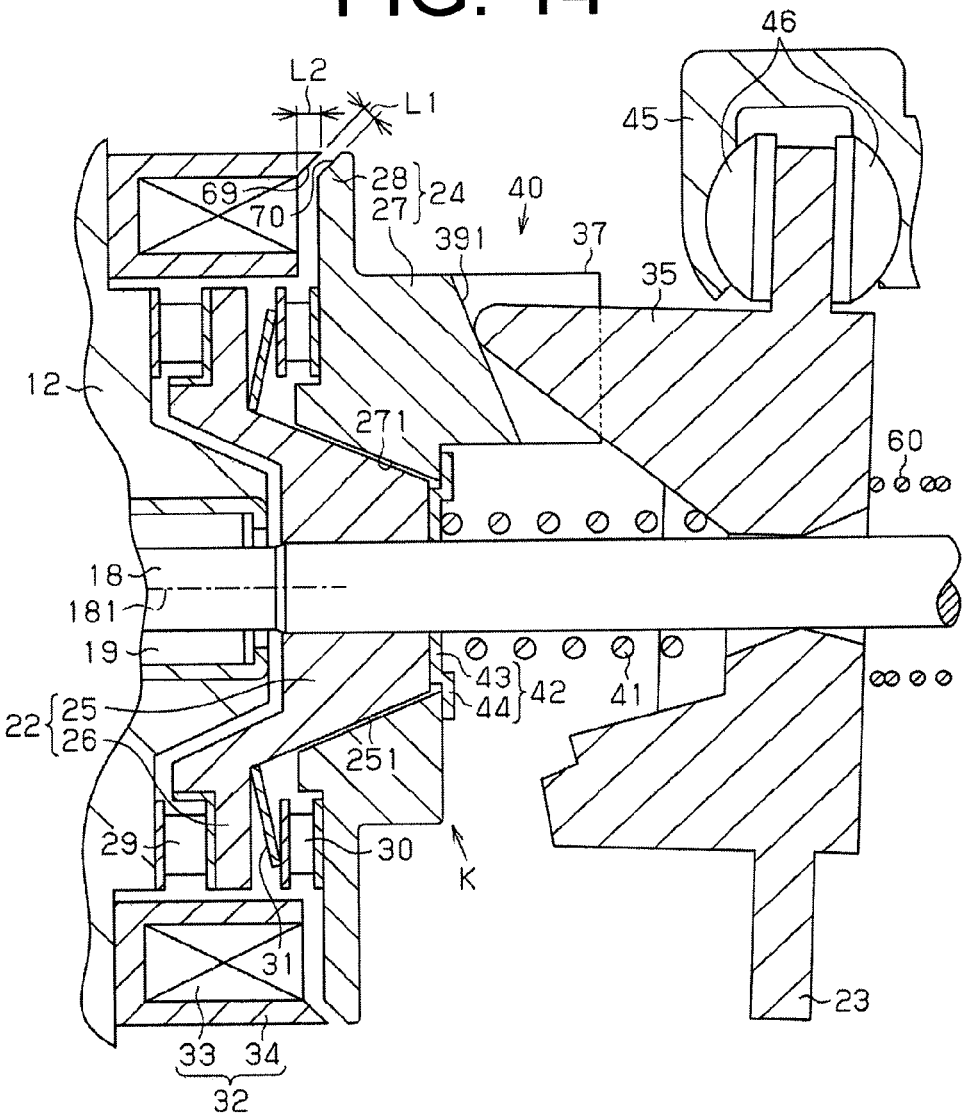
FIG. 14 is a partially enlarged sectional view of a swash plate of a variable displacement compressor according to a seventh embodiment of the present invention, showing a state where the swash plate is placed at the minimum inclination angle position.
Figure 15:
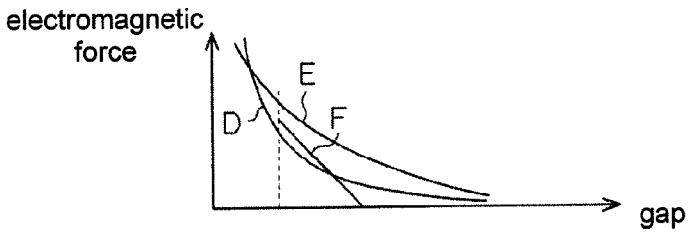
FIG. 15 is a graph illustrating relationship of the gap and the electromagnetic force.

The following will describe the seventh embodiment of the present invention with reference to FIGS. 14 and 15. The same reference numerals are used for the common elements or components in the first and seventh embodiments, and the description of such elements or components for the seventh embodiment will be omitted.

Referring to FIG. 14, the coil holder 34 has a projection extending from the radially outer annular end of the coil holder 34 toward the attraction receiving portion 28 of the second rotor 24 and having a surface 69 that is tapered away from the second rotor 24. The attraction receiving portion 28 of the second rotor 24 has a radially outer portion (or annular portion) having a surface 70 that is tapered toward the solenoid 32. The tapered surface 70 faces the tapered surface 69 so as to be complementary to the tapered surface 69. A gap L1 is formed between the tapered surface 69 of the solenoid 32 and its complementary tapered surface 70 of the attraction receiving portion 28 of the second rotor 24 when the cone clutch K is in the disengaged state. L2 in FIG. 14 represents a gap between the solenoid 32 and the attraction receiving portion 28 of the second rotor 24 when the cone clutch K is in the disengaged state, as measured in the direction parallel to the axis 181. As apparent from the drawing, L1 is smaller than L2. The provision of the tapered surfaces 69 and 70 that provide the smaller gap L1 increases the electromagnetic force of the solenoid 32 acting on the attraction receiving portion 28.

Referring to FIG. 15, the horizontal axis and vertical axis of the graph represent the magnitude of the gap and the electromagnetic force. The curve D shows an example of the change of the electromagnetic force produced when the tapered surfaces 69 and 70 are not provided. The curve E shows an example of the change of the electromagnetic force produced when the tapered surfaces 69 and 70 are provided. The straight line F shows an example of the change of the spring force of the disc spring 31. A disc spring such as 31 having a larger spring force may be used when the tapered surfaces 69 and 70 are provided than when no such tapered surfaces are provided. That is, although the disc spring 31 having a large spring force is used, shifting of the electromagnetic clutch from the disengaged state to the engaged state and vice versa can be done steadily.

As described above, while the cone clutch K is in the disengaged state, there is fear that the second rotor 24 may be inclined by the arms 35 and 36 then pressing against the cam surface 391. If the second rotor 24 is inclined, the gap between the solenoid 32 and the attraction receiving portion 28 along the circumference of the attraction receiving portion 28 becomes non-uniform. The gap between the solenoid 32 and the attraction receiving portion 28 is minimum at a position adjacent to the hinge mechanism 40 in the circumferential direction of the second rotor 24. Such non-uniformity of the gap makes non-uniform the electromagnetic force of the solenoid 32 acting on the attraction receiving portion 28 in the circumferential direction of the attraction receiving portion 28. In this case, the electromagnetic force acting on the attraction receiving portion 28 at a position adjacent to the hinge mechanism 40 is maximum. When the solenoid 32 is energized with the second rotor 24 thus inclined, the above-described non-uniform gap is further increased (or the second rotor 24 is further inclined).

As is apparent from the curves E and D in FIG. 15, the rate of the change of the electromagnetic force relative to the change of the gap is smaller when the tapered surfaces 69 and 70 are provided than when the same tapered surfaces are not provided. That is, the provision of the tapered surfaces 69 and 70 helps to reduce the non-uniformity in the circumferential direction of the attraction receiving portion 28, of the electromagnetic force of the solenoid 32 acting on the attraction receiving portion 28. This helps to reduce the inclination of the second rotor 24 occurring in energizing the solenoid 32.

Figure 16:
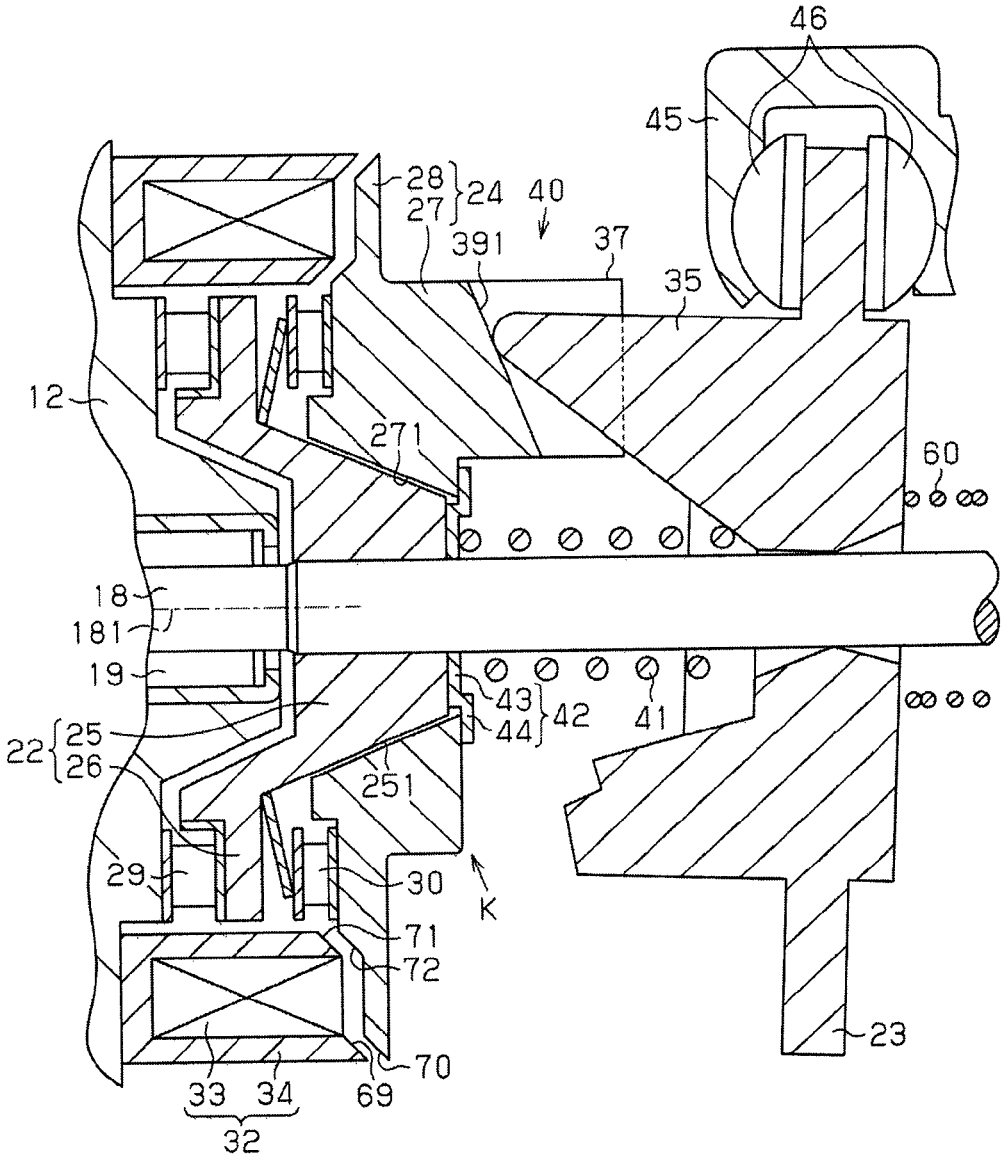
FIG. 16 is a partially enlarged sectional view of a swash plate of a variable displacement compressor according to an eighth embodiment of the present invention, showing a state where the swash plate is placed at the minimum inclination angle position.

The following will describe the eighth embodiment of the present invention with reference to FIG. 16. The same reference numerals are used for the common elements or components in the seventh and eighth embodiments, and the description of such elements or components for the eighth embodiment will be omitted.

Referring to FIG. 16, the coil holder 34 has at the radially inner annular end adjacent to the second rotor 24 a surface 71 that is tapered away from the attraction receiving portion 28 of the second rotor 24. The attraction receiving portion 28 of the second rotor 24 has a radially inner portion (or annular portion) having a surface 72 that is tapered toward the coil holder 34. The tapered surface 72 faces the tapered surface 71 so as to be complementary to the tapered surface 71.

The eighth embodiment has substantially the same advantageous effects as the seventh embodiment. In addition, the eighth embodiment wherein the tapered surfaces 71 and 72 are added causes more the electromagnetic force of the solenoid 32 acting on the attraction receiving portion 28 than the seventh embodiment.

Figure 17:
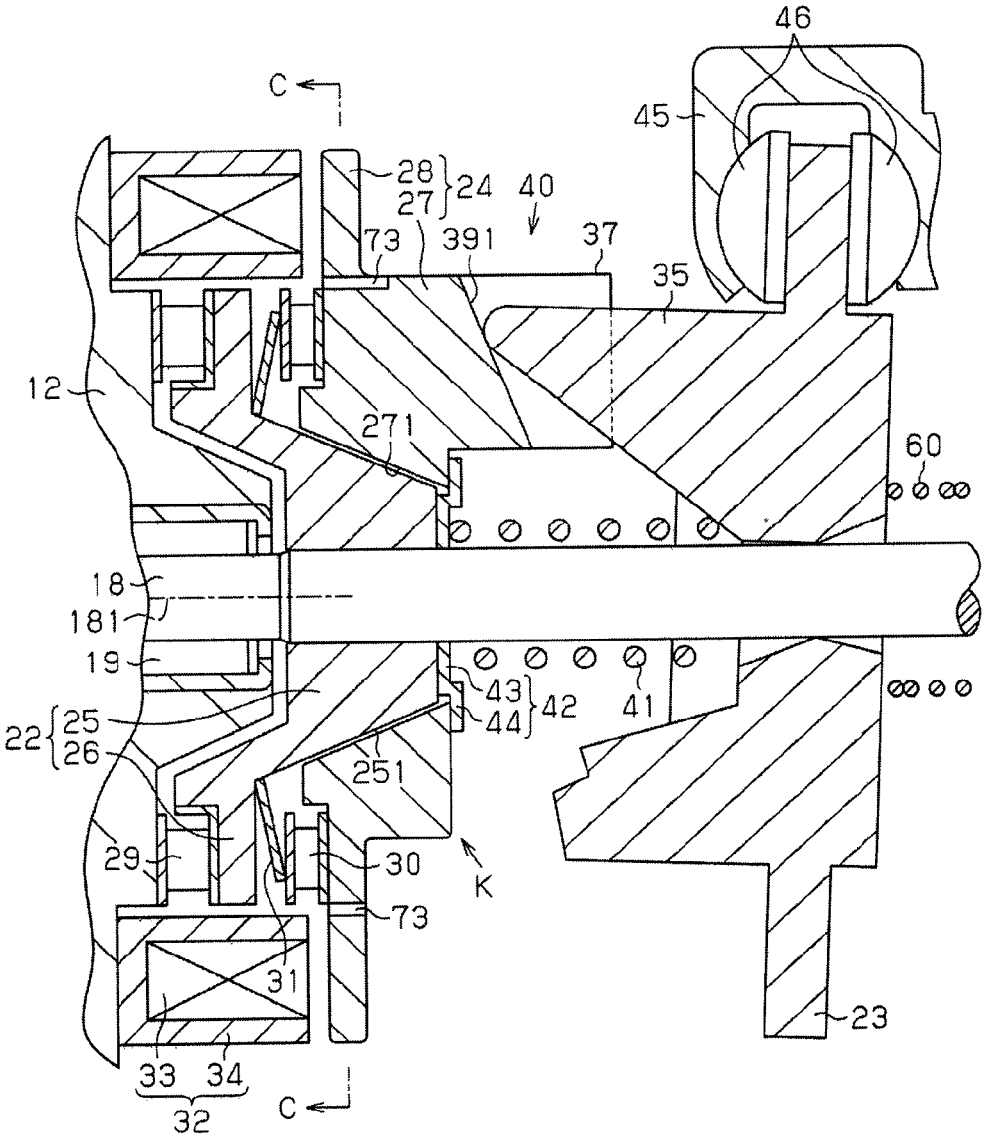
FIG. 17 is a partially enlarged sectional view of a swash plate of a variable displacement compressor according to a ninth embodiment of the present invention, showing a state where the swash plate is placed at the minimum inclination angle position.
Figure 18:
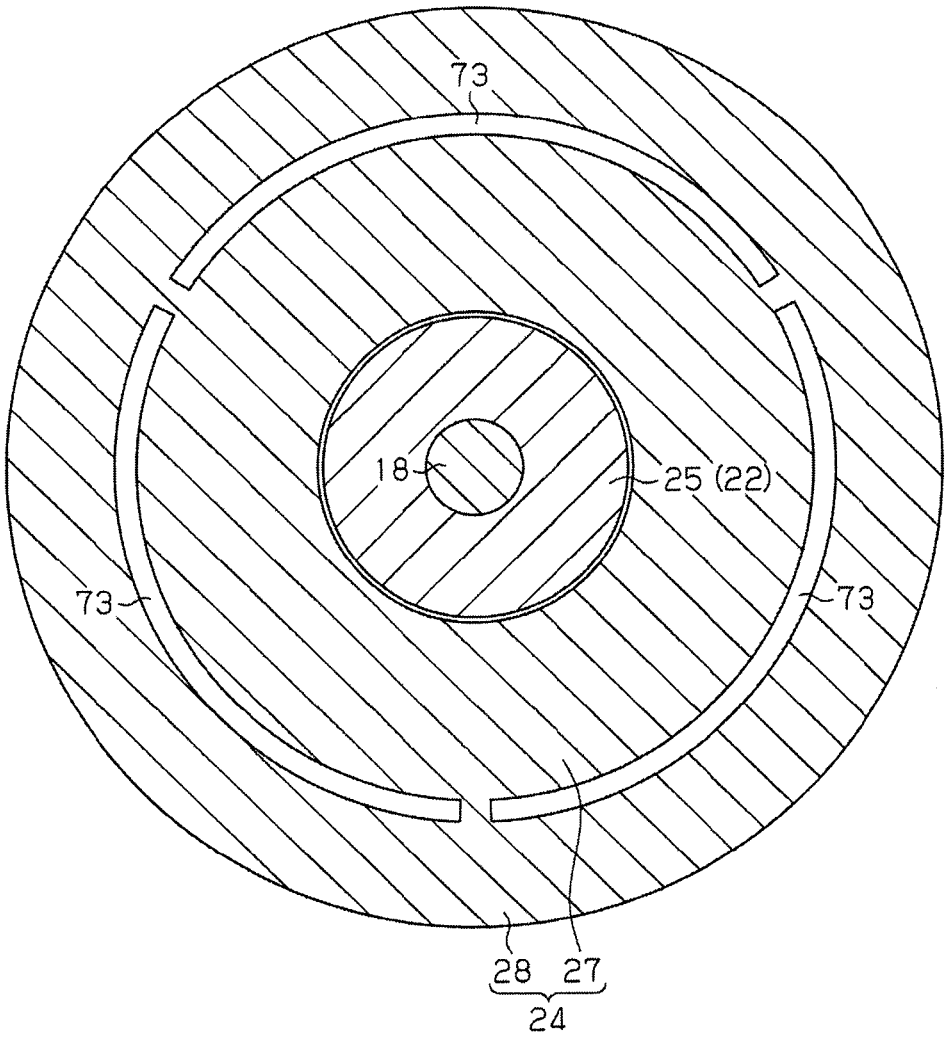
FIG. 18 is a cross sectional view showing the variable displacement compressor as taken along the line C-C of FIG. 17.

The following will describe the ninth embodiment of the present invention with reference to FIGS. 17 and 18. The same reference numerals are used for the common elements or components in the first and ninth embodiments, and the description of such elements or components for the ninth embodiment will be omitted.

Referring to FIGS. 17 and 18, the second rotor 24 has therethrough a plurality of arched voids 73 that are formed in a concentric manner. The voids 73 are located radially inward of the solenoid 32 as viewed in the direction of the axis 181. The voids 73 are a flux barrier located radially inward of the attraction receiving portion 28. That is, the voids 73 serve to reduce flux leakage from the attraction receiving portion 28 of the second rotor 24 to the rotary shaft 18 via the female cone portion 27 and the male cone portion 25, and also to reduce flux leakage from the attraction receiving portion 28 to the swash plate 23 via the female cone portion 27. The reduction of the flux leakage inhibits the reduction of the electromagnetic force of the solenoid 32 acting on the attraction receiving portion 28.

Figure 19:
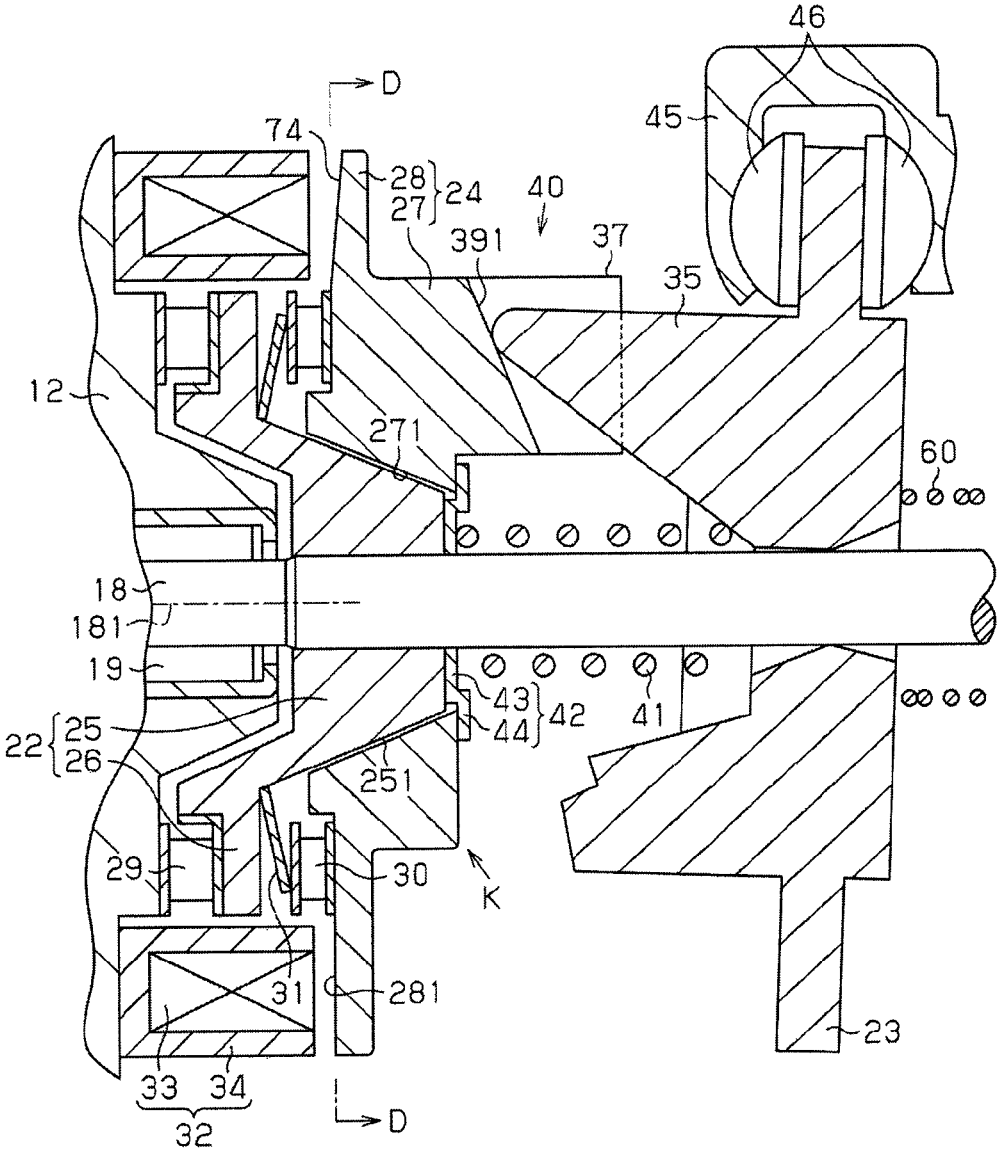
FIG. 19 is a partially enlarged sectional view of a swash plate of a variable displacement compressor according to a tenth embodiment of the present invention, showing a state where the swash plate is placed at the minimum inclination angle position.
Figure 20:
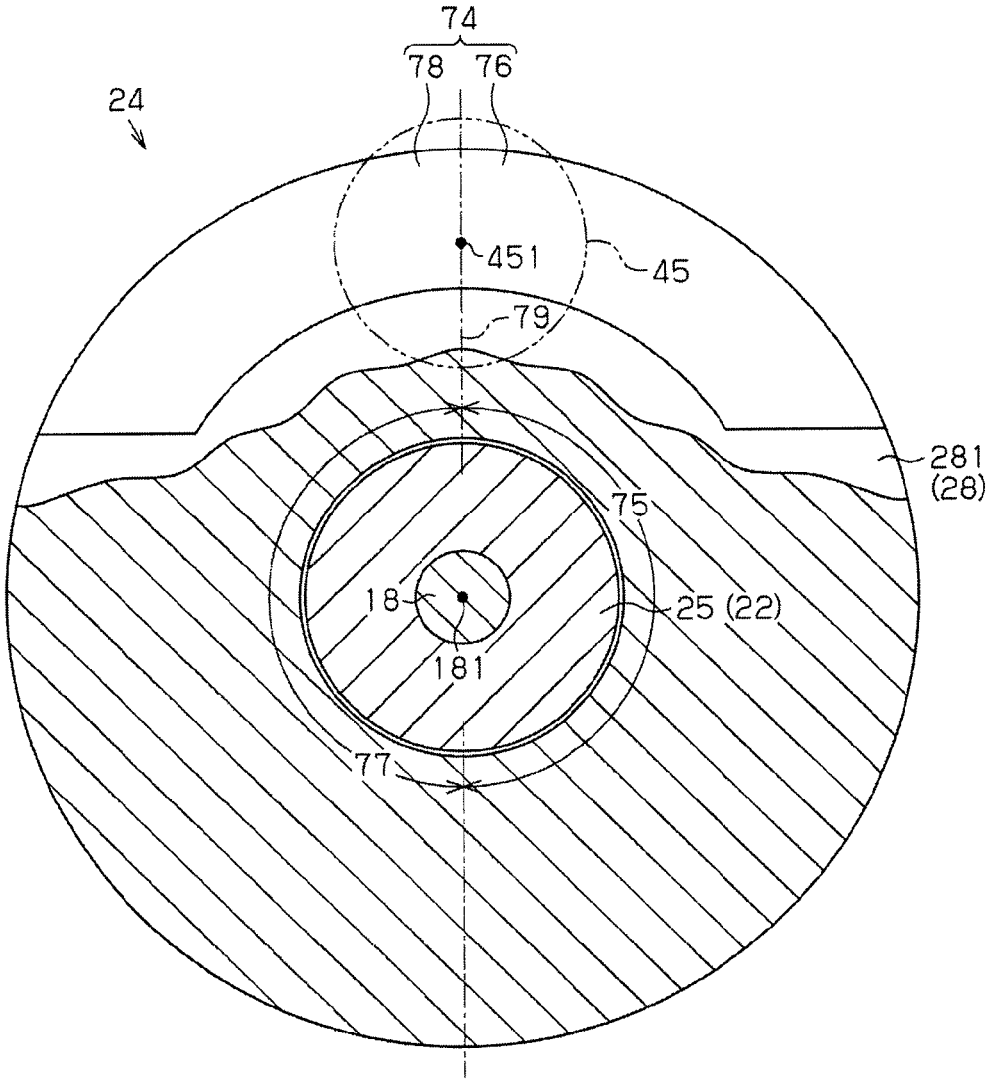
FIG. 20 is a cross sectional view showing the variable displacement compressor as taken along the line D-D of FIG. 19.

The following will describe the tenth embodiment of the present invention with reference to FIGS. 19 and 20. The same reference numerals are used for the common elements or components in the first and tenth embodiments, and the description of such elements or components for the tenth embodiment will be omitted.

Referring to FIG. 20, the surface 281 of the attraction receiving portion 28 of the second rotor 24 has a compression-stroke corresponding region 75 and a suction-stroke corresponding region 77. Referring to FIGS. 19 and 20, a part of the compression-stroke corresponding region 75 which is designated by 76 and a part of the suction-stroke corresponding region 77 which is designated by 78 cooperate to form a planar inclined portion 74 that is spaced from the solenoid 32 with a radially outwardly increasing spaced distance. The boundary between the part 76 of the compression-stroke corresponding region 75 and the part 78 of the suction-stroke corresponding region 77 is located at the top-dead-center corresponding position 79. The compression-stroke corresponding region 75 is an angular range which is centered around the axis 181 and in which the axial centers 451 of the pistons 45 (only one piston being shown in FIG. 20) in the compression stroke are present. The suction-stroke corresponding region 77 is an angular range which is centered around the axis 181 and in which the axial centers 451 of the pistons 45 in the suction stroke are present. The hinge mechanism 40 is located behind the inclined portion 74 of the second rotor 24.

While the cone clutch K is in the disengaged state, there is fear that the second rotor 24 may be inclined in the direction that causes the upper side of the attraction receiving portion 28 of FIG. 19 to be moved toward the solenoid 32. The presence of the inclined portion 74 of the attraction receiving portion 28 of the second rotor 24 helps to prevent the attraction receiving portion 28 of the second rotor 24 from being moved into harmful contact with the solenoid 32.

Figure 21:
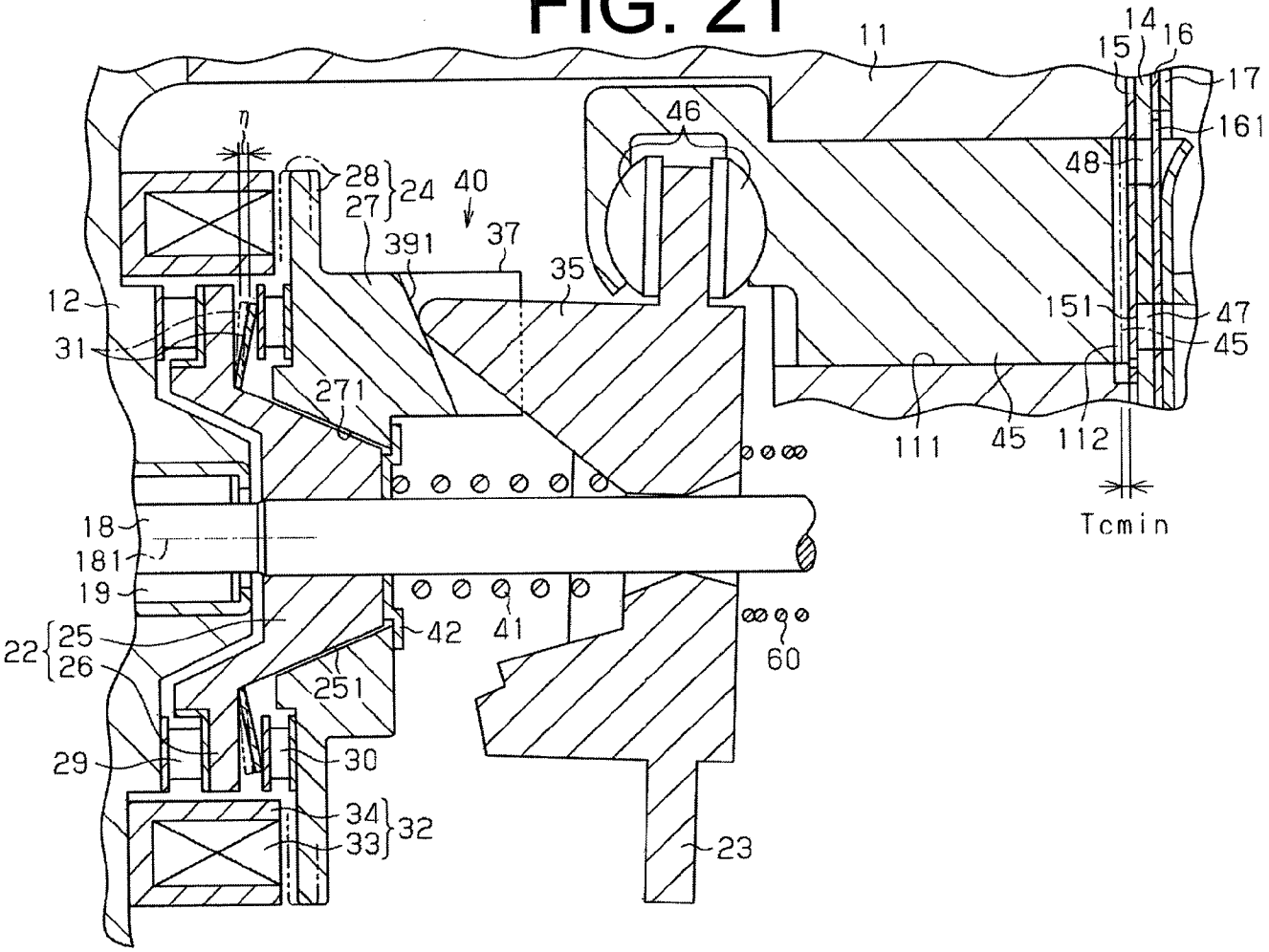
FIG. 21 is a partially enlarged sectional view of a swash plate of a variable displacement compressor according to an eleventh embodiment of the present invention, showing a state where the swash plate is placed at the minimum inclination angle position.
Figure 22:
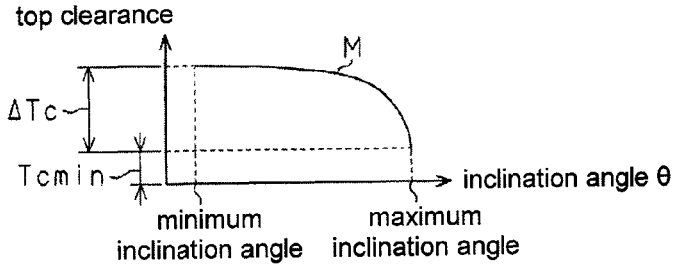
FIG. 22 is a graph illustrating a change of top clearance of a piston of the variable displacement compressor of FIG. 21.

The following will describe the eleventh embodiment of the present invention with reference to FIGS. 21 and 22. The same reference numerals are used for the common elements or components in the first and eleventh embodiments, and the description of such elements or components for the eleventh embodiment will be omitted.

Referring to FIG. 21, the reference symbol $T_{cmin}$ denotes the clearance between the top end of the piston 45 and the suction valve plate 15 that is formed when the swash plate 23 is at the maximum inclination angle position. The clearance will be referred to merely as "top clearance" of the piston 45, hereinafter. The positions of the top end of the piston 45 and the attraction receiving portion 28 of the second rotor 24 when the swash plate 23 is at the maximum inclination angle position are indicated by the chain double-dashed line in FIG. 21.

Referring to FIG. 22, when the top clearance of the piston 45 that is formed when the swash plate 23 is at the minimum inclination angle position is represented by $\Delta T_c+T_{cmin}$, and the amount of elastic deformation of the disc spring 31 (spring member) when the cone clutch K is engaged is represented by $\eta$, $\Delta T_c$ is set so as to meet the relational expression $T_{cmin}+\Delta T_c \geq \eta$.

The horizontal axis of the graph represents the inclination angle $\theta$ of the swash plate 23 and the vertical axis of the graph represents the dimension of the top clearance of the piston 45. The curve M shows a change of the top clearance.

If the top end of the piston 45 comes into contact with the suction valve plate 15 while the swash plate 23 is at the minimum inclination angle position, the spring force of the disc spring 31 produced when the swash plate 23 is at the minimum inclination angle position acts on the piston 45. The reaction force of the spring force urges the second rotor 24 toward the first rotor 22. This makes it easier for the second rotor 24 to rotate with the first rotor 22 thereby to increase the mechanical loss of the variable displacement compressor 10.

By setting the $\Delta T_c$ as described above, however, the contact between the top end of the piston 45 and the suction valve plate 15 is avoided.

Figure 23:
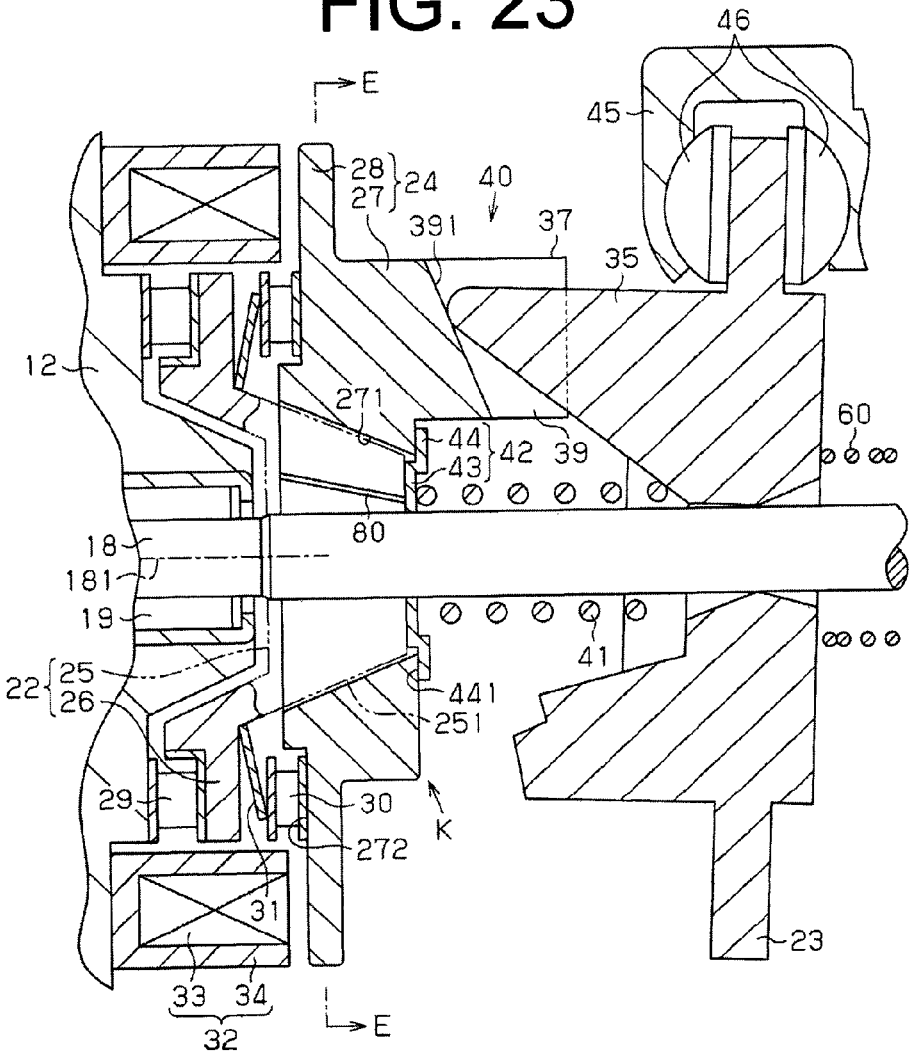
FIG. 23 is a partially enlarged sectional view of a swash plate of a variable displacement compressor according to a twelfth embodiment of the present invention, showing a state where the swash plate is placed at the minimum inclination angle position.
Figure 24:
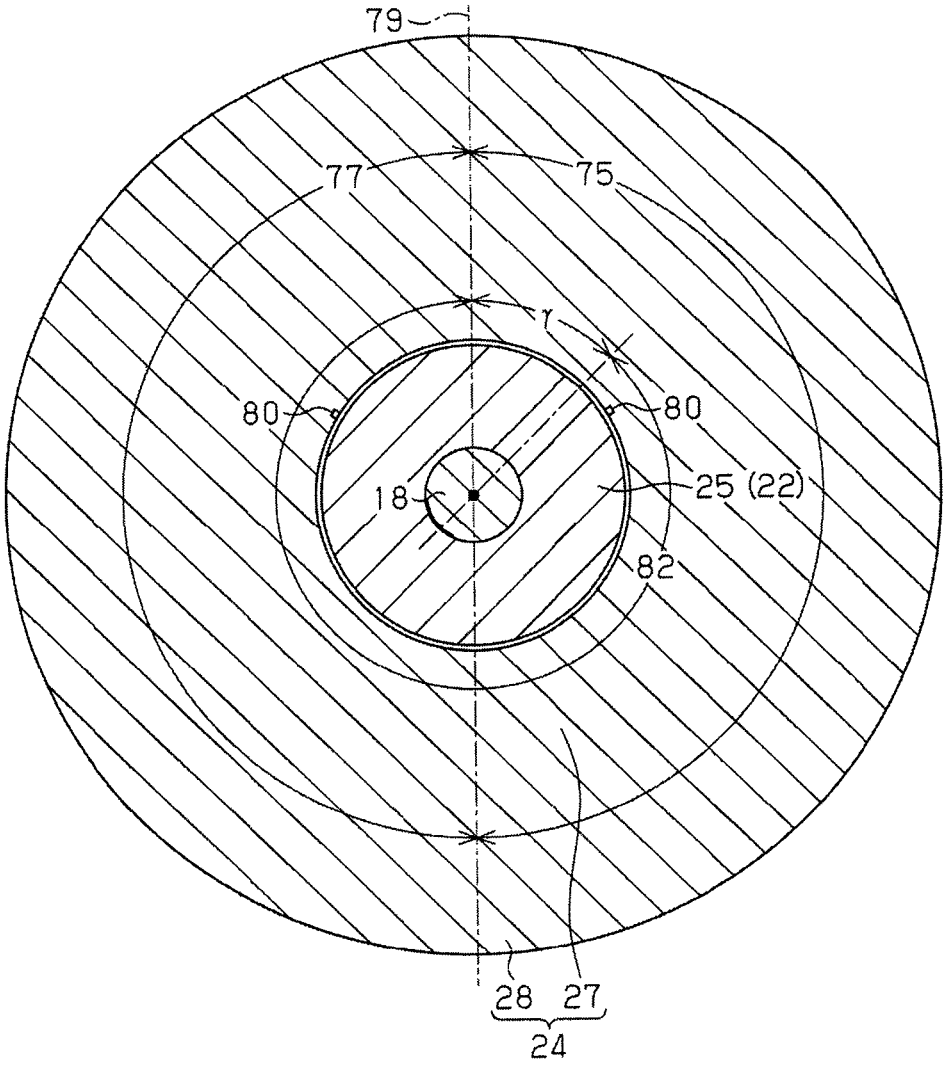
FIG. 24 is a cross sectional view showing the variable displacement compressor as taken along the line E-E of FIG. 23.

The following will describe the twelfth embodiment of the present invention with reference to FIGS. 23 and 24. The same reference numerals are used for the common elements or components in the first and twelfth embodiments, and the description of such elements or components for the twelfth embodiment will be omitted.

Referring to FIGS. 23 and 24, a pair of grooves 80 (only one groove being shown in FIG. 23) is formed in the conical surface 271 of the second rotor 24 so as to extend linearly across the conical surface 271. The pair of grooves 80 is formed at positions within an angular range 82 around the axis 181. As shown in FIG. 24, the angular range 82 covers an angular range around the axis 181 excepting the angular range $\gamma$ ranging from the top-dead-center corresponding position 79 to a position that is spaced at a predetermined angle $\gamma$ in the compression-stroke corresponding region 75. The angular range $\gamma$ is, for example, 45°. When the swash plate 23 is being moved from the minimum inclination angle position, or when the cone clutch K is being shifted from the disengaged state to the engaged state, partial contact tends to occur between the conical surfaces 251 and 271 in the angular range $\gamma$. If any groove such as 80 is formed in the annular range $\gamma$, a wear tends to occur in the angular range $\gamma$. The angular range 82 within which the grooves 80 are formed is set for prevention of the wear.

The grooves 80 allow lubricating oil to flow smoothly into the gap between the conical surfaces 251 and 271. The grooves 80 also serve any foreign matters present between the conical surfaces 251 and 271 to be caught. If grooves such as 80 are formed in the conical surface 251 of the first rotor 22, there is fear that the foreign matters may be flown out of the grooves 80 into the gap between the conical surfaces 251 and 271 once again by the centrifugal force caused by the rotation of the first rotor 22. In the present embodiment wherein the grooves 80 are formed in the conical surface 271, however, such problem may be prevented.

Figure 25:
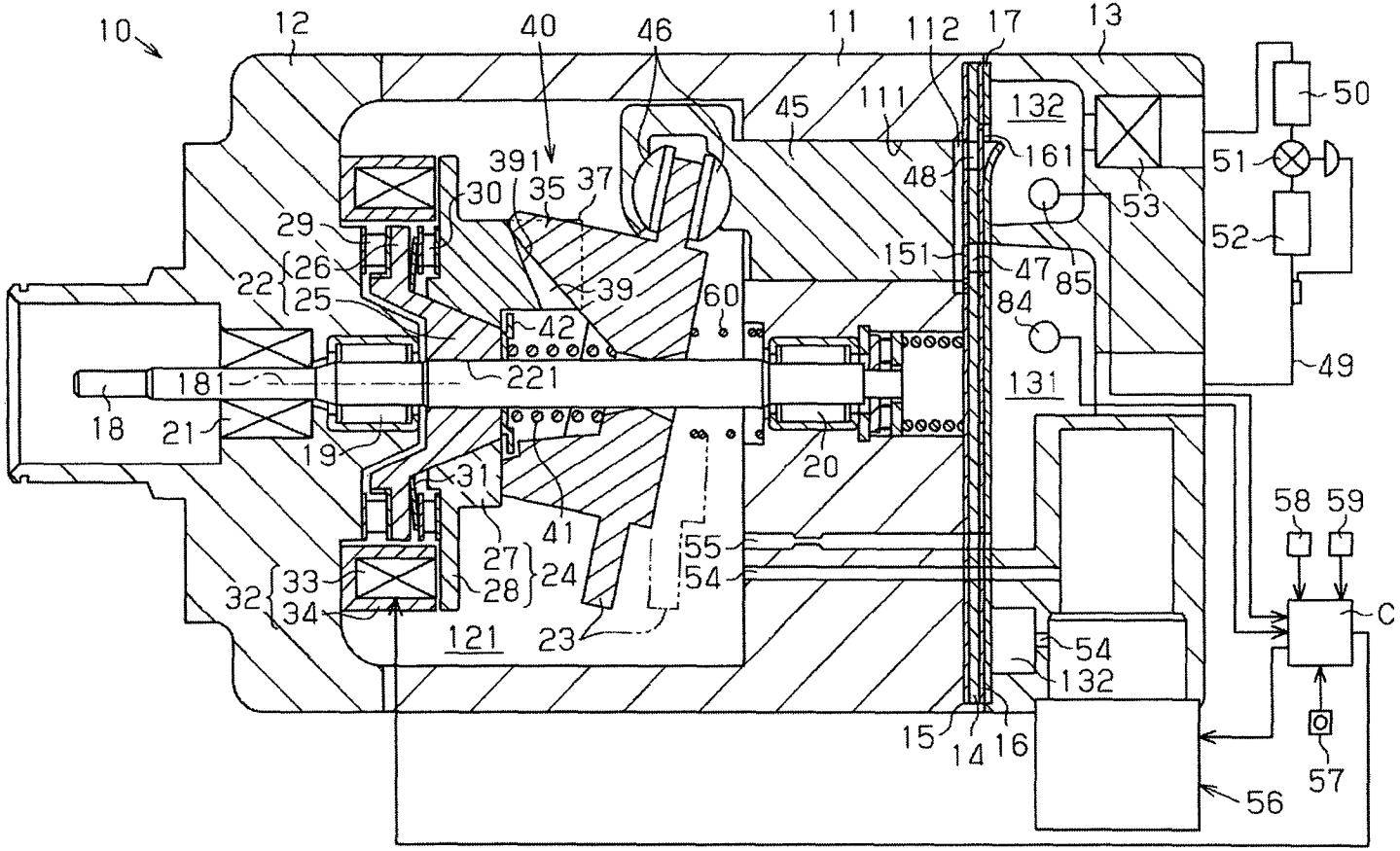
FIG. 25 is a longitudinal sectional view showing a variable displacement compressor according to a thirteenth embodiment of the present invention and its related devices.
Figure 26:
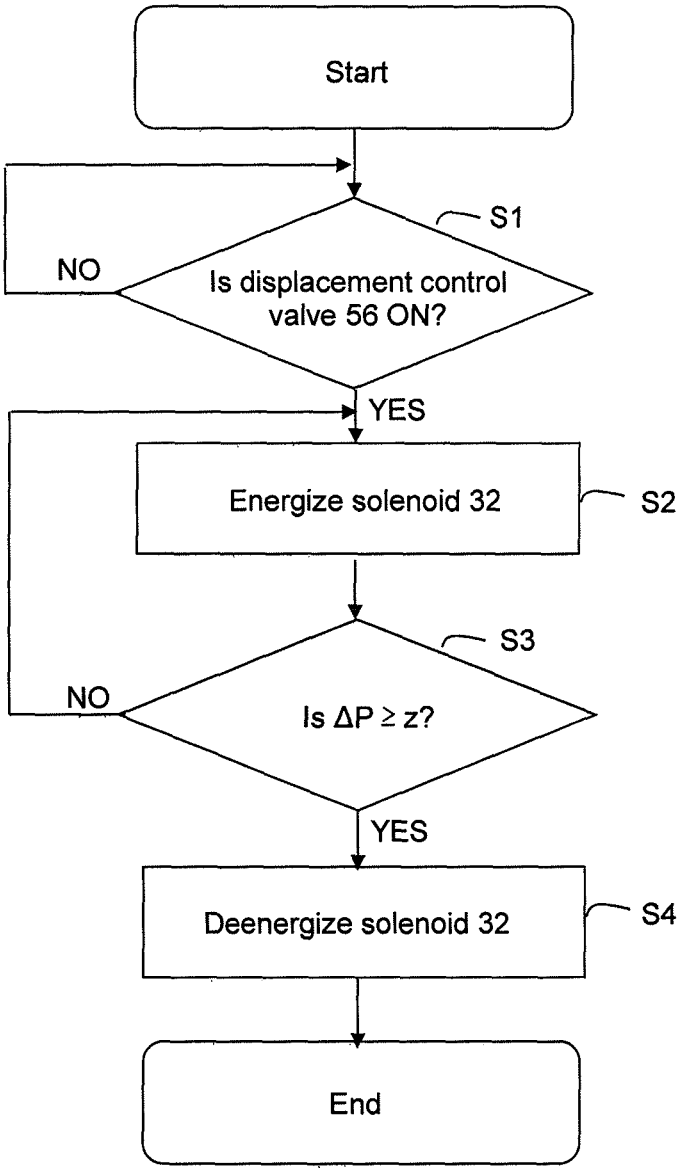
FIG. 26 is a flowchart illustrating the operation of the variable displacement compressor of FIG. 25.

The following will describe the thirteenth embodiment of the present invention with reference to FIGS. 25 and 26. The same reference numerals are used for the common elements or components in the first and thirteenth embodiments, and the description of such elements or components for the thirteenth embodiment will be omitted.

Referring to FIG. 25, a suction pressure sensor 84 and a discharge pressure sensor 85 are connected to the control computer C by signals. The suction pressure sensor 84 detects the pressure in the suction chamber 131 (or suction pressure), and the discharge pressure sensor 85 detects the pressure in the discharge chamber 132 (or discharge pressure). Data on the suction pressure detected by the suction pressure sensor 84 and data on the discharge pressure detected by the discharge pressure sensor 85 are transmitted by the respective sensors to the control computer C. The control computer C controls the energization and deenergization of the solenoid 32 based on the data on the suction pressure and the discharge pressure detected by the suction pressure sensor 84 and the discharge pressure sensor 85, respectively.

FIG. 26 is a flowchart illustrating a control program that controls the energization and deenergization of the solenoid 32. The control computer C executes the control program of FIG. 26. The following will describe the energization and deenergization control of the solenoid 32 based on the flowchart of FIG. 26.

At step S1, the control computer C determines whether or not the displacement control valve 56 is ON. If the displacement control valve 56 is ON (YES at step S1), the control computer C energizes the solenoid 32 at step S2 thereby to shift the cone clutch K from the disengaged state to the engaged state. At step S3, the control computer C determines whether or not the differential pressure ΔP (=Pd−Ps) between the discharge pressure Pd detected by the discharge pressure sensor 85 and the suction pressure Ps detected by the suction pressure sensor 84 is greater than or equal to a preset differential-pressure reference value z.

If the differential pressure ΔP does not reach the preset differential-pressure reference value z (NO at step S3), the control computer C continues the energization of the solenoid 32 at step S2. If the cone clutch K is engaged completely by the continuation of the energization of the solenoid 32, the second rotor 24 and the swash plate 23 are rotated integrally with the first rotor 22.

If the differential pressure ΔP reaches the preset differential-pressure reference value z (YES at step S3), the control computer C causes the solenoid 32 to be deenergized at step S4. If the differential pressure (=Pd−Ps) is relatively small when the swash plate 23 is at the minimum inclination angle position, the force of the swash plate 23 that presses the second rotor 24 against the first rotor 22 is also relatively small, which may cause the female cone portion 27 to slide on the male cone portion 25. If the solenoid 32 is deenergized in such a state of the differential pressure ΔP, the rotation of the first rotor 22 is not steadily transmitted to the swash plate 23 via the second rotor 24, so that the variable displacement compressor 10 fails to be started.

The differential-pressure reference value z is set so that the female cone portion 27 does not slide on the male cone portion 25. Therefore, the variable displacement compressor 10 may be steadily started.

Figure 27:
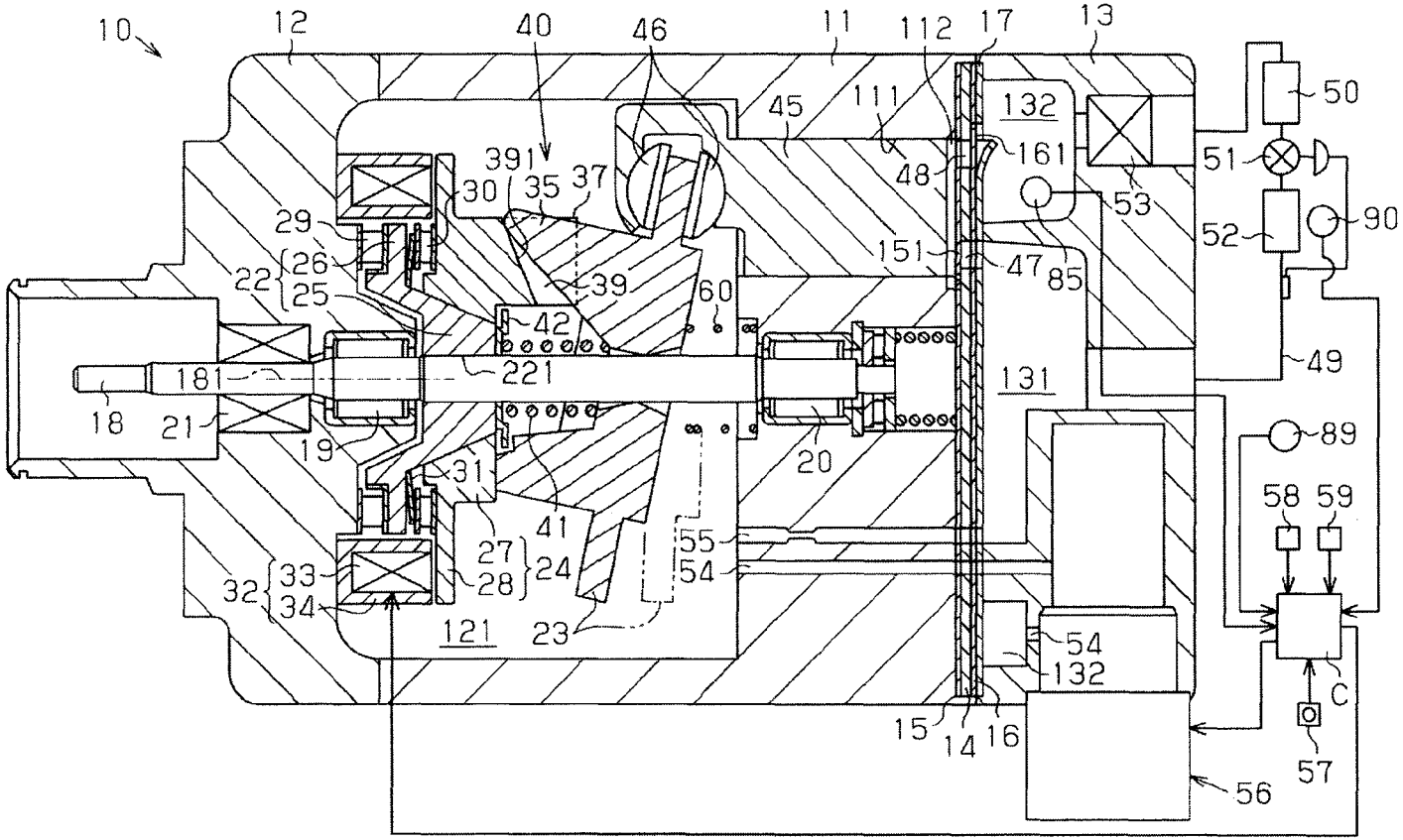
FIG. 27 is a longitudinal sectional view showing a variable displacement compressor according to a fourteenth embodiment of the present invention and its related devices.
Figure 28:
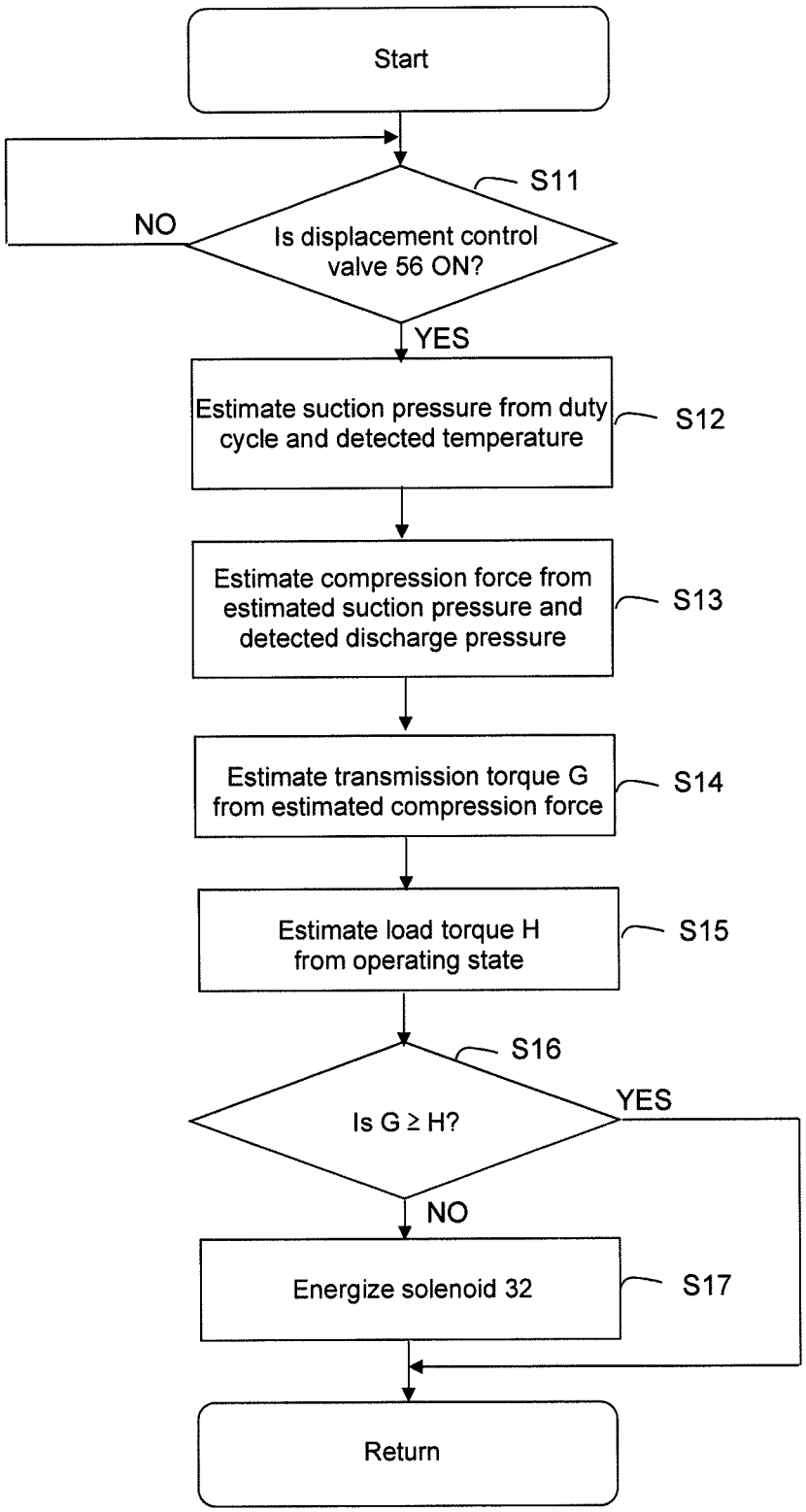
FIG. 28 is a flowchart illustrating the operation of the variable displacement compressor of FIG. 27.

The following will describe the fourteenth embodiment of the present invention with reference to FIGS. 27 and 28. The same reference numerals are used for the common elements or components in the thirteenth and fourteenth embodiments, and the description of such elements or components for the fourteenth embodiment will be omitted.

Referring to FIG. 27, a speed sensor 89 for detecting the speed of a vehicle engine (not shown) is connected to the control computer C by signals. A temperature sensor 90 for detecting the temperature of the outside air near the evaporator 52 (or blow off temperature) is connected to the control computer C by signals. Data on the speed detected by the speed sensor 89 is sent to the control computer C. The control computer C calculates the change of the speed (or rotational acceleration) based on the data on the speed detected by the speed sensor 89. The control computer C controls the energization and deenergization of the solenoid 32 based on the data of the speed and the discharge pressure detected by the speed sensor 89 and the discharge pressure sensor 85, respectively.

FIG. 28 is a flowchart illustrating a control program that controls the energization and deenergization of the solenoid 32. The control computer C executes the control program of FIG. 28. The following will describe the energization and deenergization control of the solenoid 32 based on the flowchart of FIG. 28.

At step S11, the control computer C determines whether or not the displacement control valve 56 is ON. If the displacement control valve 56 is ON (YES at step S11), the control computer C estimates at step S12 the suction pressure from the duty ratio with which the passage of the electric current through the displacement control valve 56 is controlled and the temperature detected by the temperature sensor 90. At step S13, the control computer C estimates the compression force from the estimated suction pressure and the discharge pressure detected by the discharge pressure sensor 85.

At step S14, the control computer C estimates the transmission torque G from the estimated compression force. The transmission torque G refers to a value of the torque that is transmitted by the compression force through the cone clutch K. At step S15, the control computer C estimates the load torque H from the operating conditions (the speed and the rotational acceleration) of the variable displacement compressor 10. The load torque H refers to a value of the torque that needs to be transmitted from the first rotor 22 to the second rotor 24 through the cone clutch K.

At step S16, the control computer C determines whether or not the transmission torque G is greater than or equal to the load torque H. If the transmission torque G does not reach the load torque H (NO at step S16), the control computer C energizes the solenoid 32. The energization of the solenoid 32 increases the engagement force of the cone clutch K thereby to cause the second rotor 24 to be rotated integrally with the first rotor 22.

When the displacement control valve 56 is ON and the swash plate 23 is located at a position close to the minimum inclination angle position, the variable displacement compressor 10 may be operated at the minimum displacement. Such operation of the compressor 10 occurs, for example, when the outside air temperature is extremely low. If the solenoid 32 is then in the deenergized state, there is fear that the torque of the first rotor 22 may not be transmitted to the second rotor 24, that is, the second rotor 24 may not be rotated integrally with the first rotor 22.

In the present embodiment, the integral rotation of the second rotor 24 with the first rotor 22 is steadily ensured while the variable displacement compressor 10 is operating at the minimum displacement.

Figure 29:
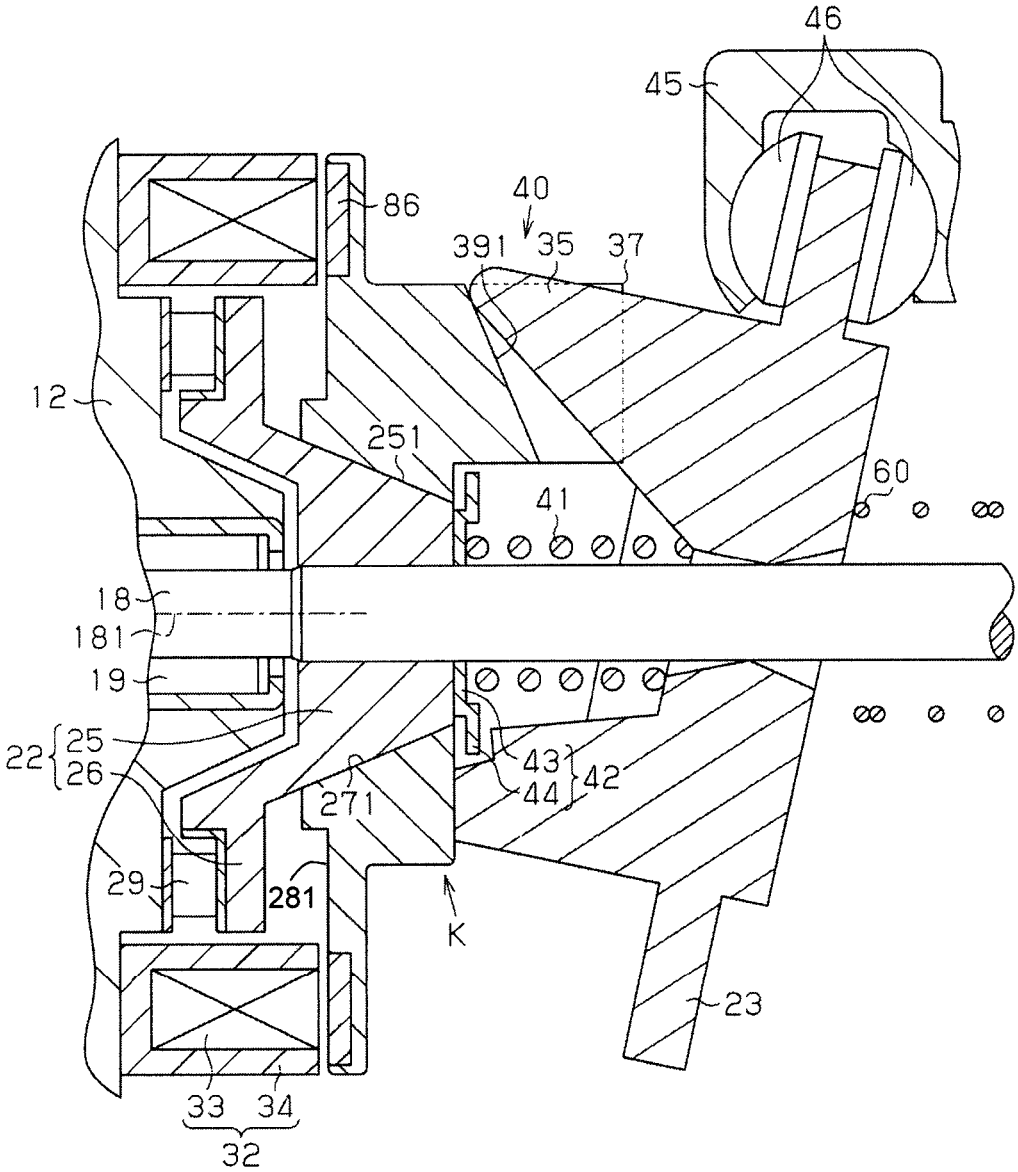
FIG. 29 is a partially enlarged sectional view of a swash plate of a variable displacement compressor according to a fifteenth embodiment of the present invention, showing a state where the swash plate is at the maximum inclination angle position.

The following will describe the fifteenth embodiment of the present invention with reference to FIG. 29. The same reference numerals are used for the common elements or components in the first and fifteenth embodiments, and the description of such elements or components for the fifteenth embodiment will be omitted.

Referring to FIG. 29, an annular permanent magnet 86 is fixedly mounted in the surface 281 of the attraction receiving portion 28 of the second rotor 24 that faces the solenoid 32. The permanent magnet 86 receives the repulsive force from the solenoid 32 by passing electric current through the coil 33 of the solenoid 32 in the direction that is opposite to the direction of the electric current that causes the cone clutch K to be engaged. Thus, the cone clutch K may be shifted from the engaged state to the disengaged state.

Figure 30:
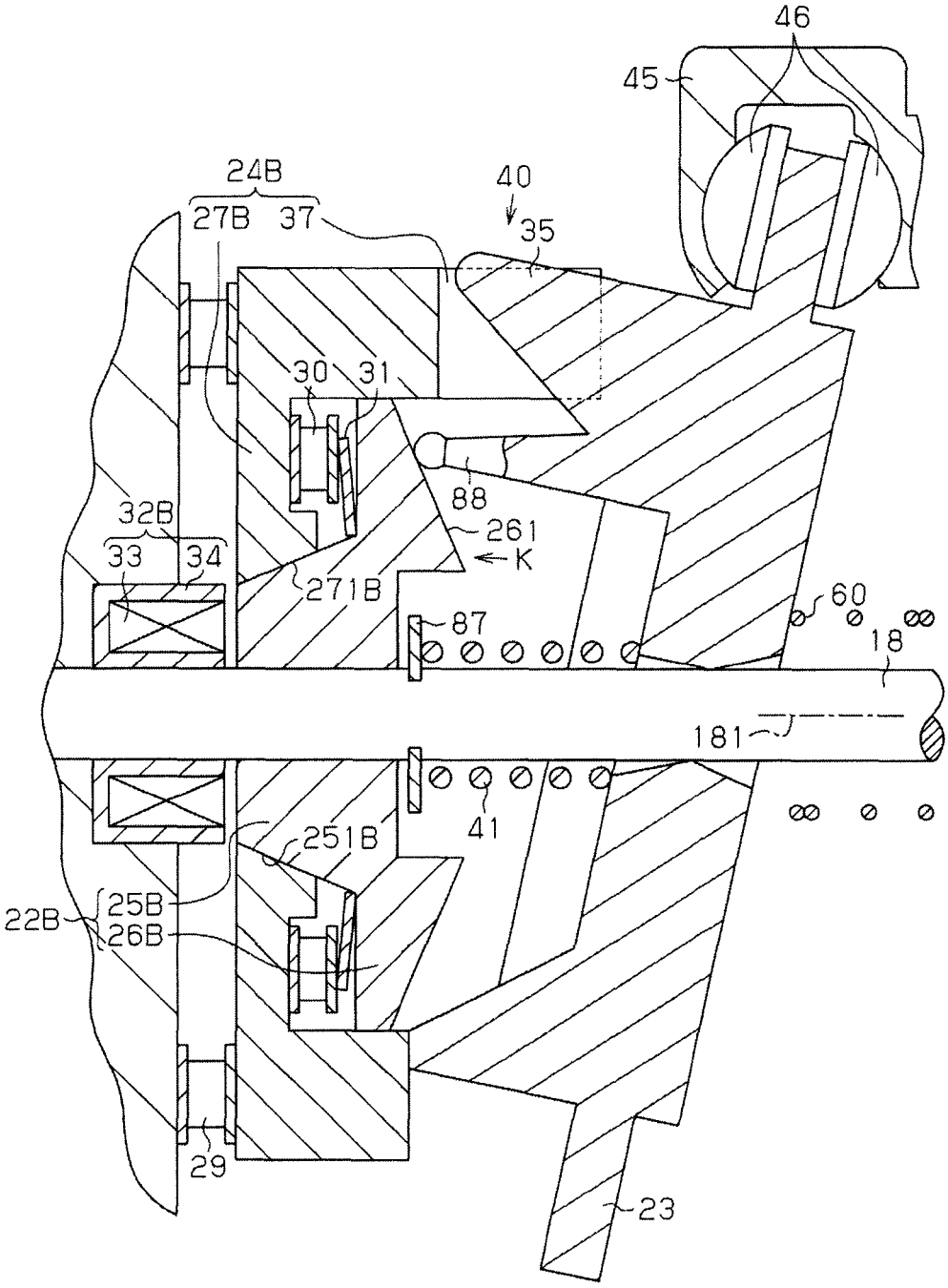
FIG. 30 is a partially enlarged sectional view of a swash plate of a variable displacement compressor according to a sixteenth embodiment of the present invention, showing a state where the swash plate is placed at the maximum inclination angle position.

The following will describe the sixteenth embodiment of the present invention with reference to FIG. 30. The same reference numerals are used for the common elements or components in the first and sixteenth embodiments, and the description of such elements or components for the sixteenth embodiment will be omitted.

Referring to FIG. 30, a first rotor 22B corresponds to the first rotor 22 of the first embodiment and is made of a magnetic material. The first rotor 22B is supported by the rotary shaft 18 in such a way that the first rotor 22B is rotatable integrally with and slidable on the rotary shaft 18. The first rotor 22B has a male cone portion 25B and an annular pressure receiving portion 26B that extends radially outward from the outer periphery of the male cone portion 25B. The male cone portion 25B has a conical surface 251B. The solenoid 32B corresponds to the solenoid 32 of the first embodiment and is mounted in the front housing 12. The solenoid 32B attracts the male cone portion 25B when an electric current is passed through the coil 33.

The second rotor 24B corresponds to the second rotor 24 of the first embodiment. The second rotor 24B is fitted on and supported by the pressure receiving portion 26B of the first rotor 22B so as to be slidable and relatively rotatable on the first rotor 22B. The second rotor 24B has a female cone portion 27B and a pair of projections 37 and 38 (only one projection 37 being shown in FIG. 30). The pair of projections 37 and 38 forms a part of the hinge mechanism 40. The female cone portion 27B has a conical surface 271B. The male cone portion 25B and the female cone portion 27B cooperate to form the cone clutch K.

The thrust bearing 30 and the disc spring 31 are interposed between the male cone portion 25B of the first rotor 22B and the female cone portion 27B of the second rotor 24B. The thrust bearing 29 is interposed between the first rotor 22B and the front housing 12. The reaction force developed when the refrigerant is discharged from the compression chamber 112 is received by the front housing 12 via the swash plate 23, the second rotor 24B, the cone clutch K, the first rotor 22B and the thrust bearing 29.

An annular stop 87 is mounted on the rotary shaft 18 at a position between the inclination-angle reduction spring 41 and the male cone portion 25B of the first rotor 22B for restricting the distance of the first rotor 22B from the solenoid 32B in the direction of the axis 181.

The swash plate 23 has at a position adjacent to the hinge mechanism 40 a pressing arm 88 that extends toward the pressure receiving portion 26B of the first rotor 22B. The pressure receiving portion 26B has a cam surface 261. The end of the pressing arm 88 is in contact with the cam surface 261. The pressing arm 88 is pressed against the cam surface 261 when the swash plate 23 is changed from the minimum inclination angle position to the maximum inclination angle position. The cam surface 261 plays the role of the cam surface 391 of the first embodiment.

When the solenoid 32B is energized with the swash plate 23 located at the minimum inclination angle position, the solenoid 32B attracts the first rotor 22B thereby to shift the cone clutch K from the disengaged state to the engaged state. Thus, the rotation of the rotary shaft 18 is transmitted to the swash plate 23 via the first rotor 22B, the cone clutch K, the second rotor 24B and the hinge mechanism 40.

The sixteenth embodiment of the present invention has substantially the same effects as those which are described under the items (1), (2), (4) and (7) of the first embodiment.

Figure 31:
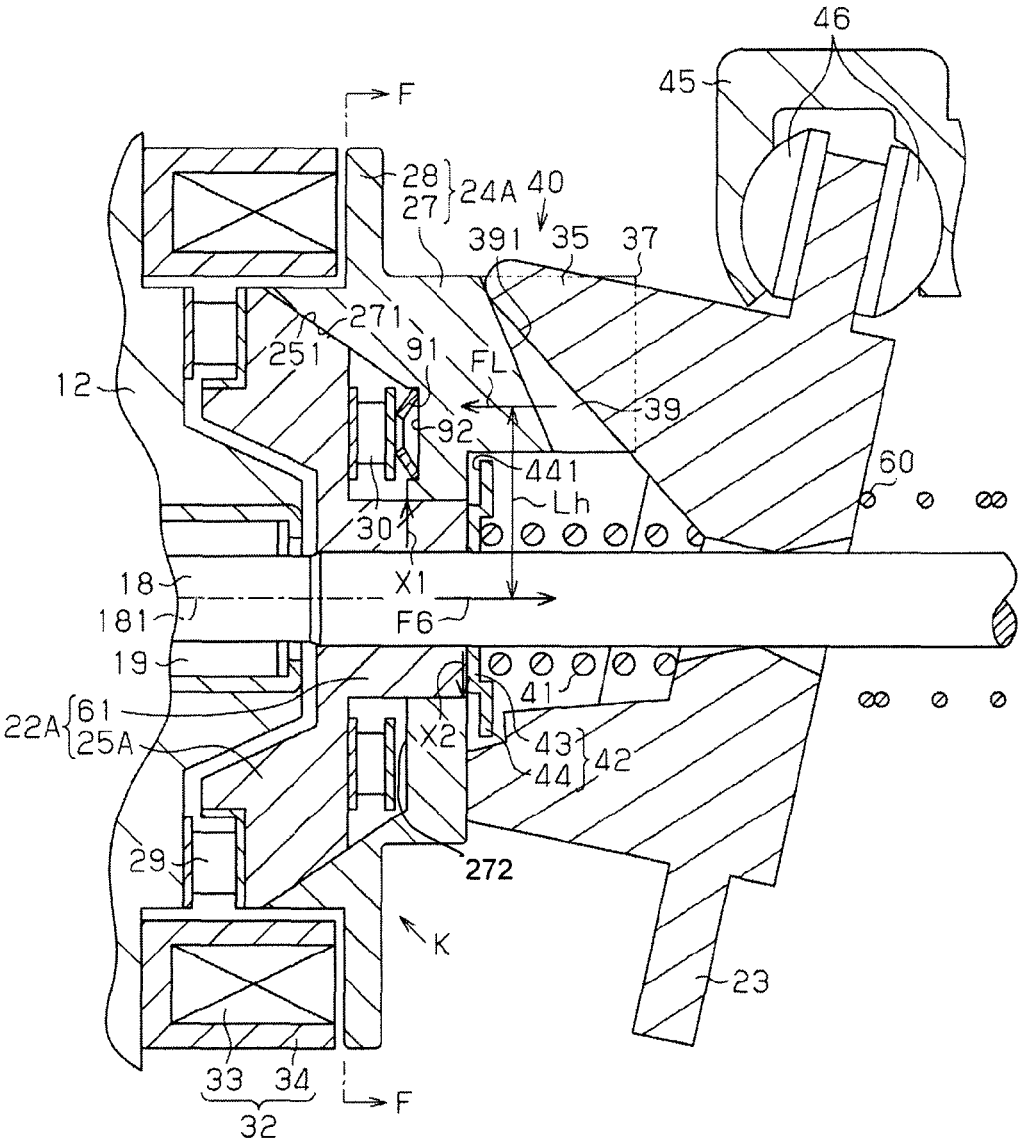
FIG. 31 is a partially enlarged sectional view of a swash plate of a variable displacement compressor according to a seventeenth embodiment of the present invention, showing a state where the swash plate is placed at the maximum inclination angle position.
Figure 32:
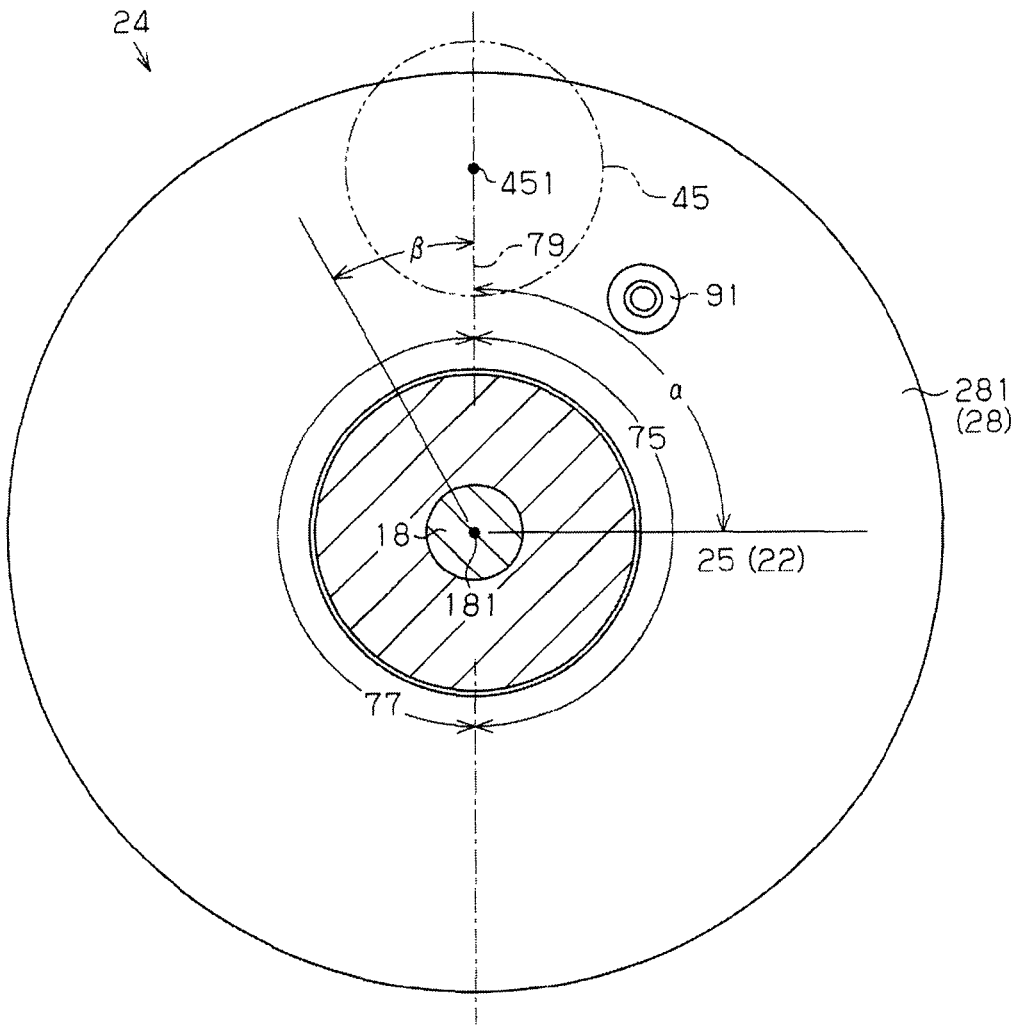
FIG. 32 is a cross sectional view showing the variable displacement compressor as taken along the line F-F of FIG. 31.

The following will describe the seventeenth embodiment of the present invention with reference to FIGS. 31 and 32. The same reference numerals are used for the common elements or components in the second and seventeenth embodiments, and the description of such elements or components for the seventeenth embodiment will be omitted.

Referring to FIG. 31, the disc spring 91 is interposed between the thrust bearing 30 and the second rotor 24A at a position adjacent to the hinge mechanism 40. The disc spring 91 is disposed in a recess 92 formed on the surface 272 of the second rotor 24A and plays the role of the disc spring 31 of the first embodiment.

Referring to FIG. 32, the disc spring 91 is positioned within an angular range α around the axis 181 that ranges between the top-dead-center corresponding position 79 and a position angularly spaced from the top-dead-center corresponding position 79 at a predetermined angle α in the compression-stroke corresponding region 75. In the embodiment of FIG. 32, the angular range α is 90°. The arrow F6 of FIG. 31 denotes an imaginary spring load produced if the disc spring 31 of the second embodiment of FIG. 6 is used instead of the disc spring 91. The arrow FL of FIG. 31 denotes the reaction force received by the swash plate 23 via the pistons 45. The spring load F6 of the disc spring 31 acts evenly on the compression-stroke corresponding region 75 and the suction-stroke corresponding region 77 of the second rotor 24A.

The reaction force FL is larger in the compression-stroke corresponding region 75 than in the suction-stroke corresponding region 77. That is, the reaction force FL acts on the second rotor 24A eccentrically. Therefore, a moment FL×Lh is produced acting on the second rotor 24A.

When the displacement control valve 56 (refer to FIG. 1) is switched from ON state to OFF state, or when the cone clutch K is shifted from the engaged state to the disengaged state, the moment FL×Lh acting on the second rotor 24A causes the second rotor 24A to incline relative to the first rotor 22A thereby to apply forces X1 and X2 to the second rotor 24A. Thus, the second rotor 24A moved when the displacement control valve 56 is switched from the ON state to the OFF state is subjected to friction force caused by the forces X1 and X2. The friction force caused by the moment FL×Lh prevents the second rotor 24A from moving smoothly, or prevents the cone clutch K from being shifted smoothly from the engaged state to the disengaged state.

In the present embodiment wherein the disc spring 91 is positioned within the angular range α of FIG. 32, the spring load of the disc spring 91 prevents the inclination of the second rotor 24A relative to the first rotor 22A against the eccentric load of the reaction force FL thereby to allow the second rotor 24A to move smoothly (or to allow the cone clutch K to be shifted smoothly from the engaged state to the disengaged state).

Figure 33:
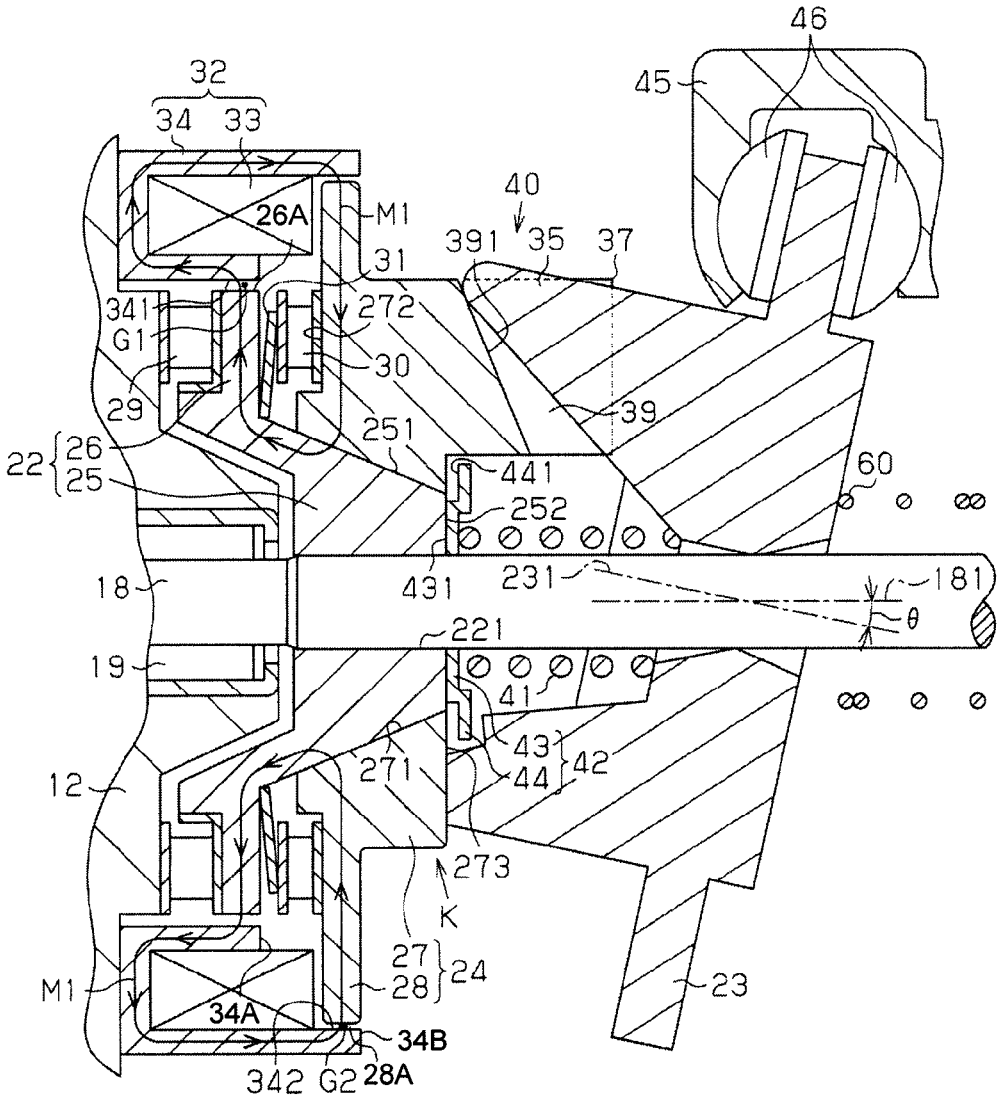
FIG. 33 is a partially enlarged sectional view of a swash plate of a variable displacement compressor according to an eighteenth embodiment of the present invention, showing a state where the swash plate is placed at the maximum inclination angle position.

The following will describe the eighteenth embodiment of the present invention with reference to FIG. 33. The same reference numerals are used for the common elements or components in the first and eighteenth embodiments, and the description of such elements or components for the eighteenth embodiment will be omitted.

Referring to FIG. 33, the coil holder 34 has at the rear end thereof a radially inner annular end surface 34A and a radially outer annular end surface 34B. The annular end surface 34A is closer to the second rotor 24 in the direction of the axis 181 than an outer peripheral surface 26A of the pressure receiving portion 26 of the first rotor 22. The coil holder 34 has on the radially inner annular portion thereof a first surface 341 that faces the outer peripheral surface 26A of the pressure receiving portion 26 of the first rotor 22. A first gap G1 is formed between the outer peripheral surface 26A of the pressure receiving portion 26 and the first surface 341 so as to form a path of magnetic flux that flows in the radial direction of the rotary shaft 18.

The annular end surface 34A is not located close to the second rotor 24. A gap is formed between the annular end surface 34A and the second rotor 24 for preventing magnetic flux from flowing in the direction of the axis 181 between the annular end surface 34A and the second rotor 24.

The annular end surface 34B is located closer to the swash plate 23 in the direction of the axis 181 than the outer peripheral surface 28A of the attraction receiving portion 28 of the second rotor 24. The coil holder 34 has on the radially outer annular portion thereof a second surface 342 that faces the outer peripheral surface 28A of the attraction receiving portion 28 of the second rotor 24. A second gap G2 is formed between the outer peripheral surface 28A of the attraction receiving portion 28 and the second surface 342 of the coil holder 34 so as to form a path of magnetic flux that flows in the radial direction of the rotary shaft 18. The disc spring 31 of the present embodiment is made of a non-magnetic material such as a stainless material.

When the solenoid 32 is energized, the magnetic flux developed in the coil holder 34 flows from the second surface 342 in the radial direction of the rotary shaft 18 to the outer peripheral surface 28A of the attraction receiving portion 28 of the second rotor 24 via the second gap G2. The magnetic flux flowed to the second rotor 24 then flows to the first rotor 22 via a gap between the conical surfaces 251 and 271 of the first and second rotors 22 and 24. The magnetic flux flowed to the first rotor 22 flows from the outer peripheral surface 26A of the pressure receiving portion 26 in the radial direction of the rotary shaft 18 to the first surface 341 of the coil holder 34 via the first gap G1. That is, the magnetic flux developed in the coil holder 34 flows back to the coil holder 34 via the second gap G2, the second rotor 24, the conical surfaces 251, 271, the first rotor 22 and the first gap G1, thus forming a magnetic circuit M1.

The magnetic flux that forms the magnetic circuit M1 causes the conical surface 271 of the second rotor 24 to be attracted to the conical surface 251 of the first rotor 22 thereby to bring the conical surface 271 into contact with the conical surface 251. In the present embodiment, the disc spring 31 that is made of a non-magnetic material prevents the magnetic flux from leaking from the second rotor 24 to the first rotor 22 via the thrust bearing 30 and the disc spring 31, so that the magnetic flux flows through the gap between the conical surfaces 251 and 271.

In order to adjust the gaps G1 and G2 which form a part of path of the magnetic flux flowing in the radial direction of the rotary shaft 18, it is only necessary to adjust the radial length of any one of the coil holder 34, the first rotor 22 and the second rotor 24. Therefore, the required electromagnetic force of the solenoid 32 may be ensured by easy adjustment of the gaps G1 and G2.

Figure 34:
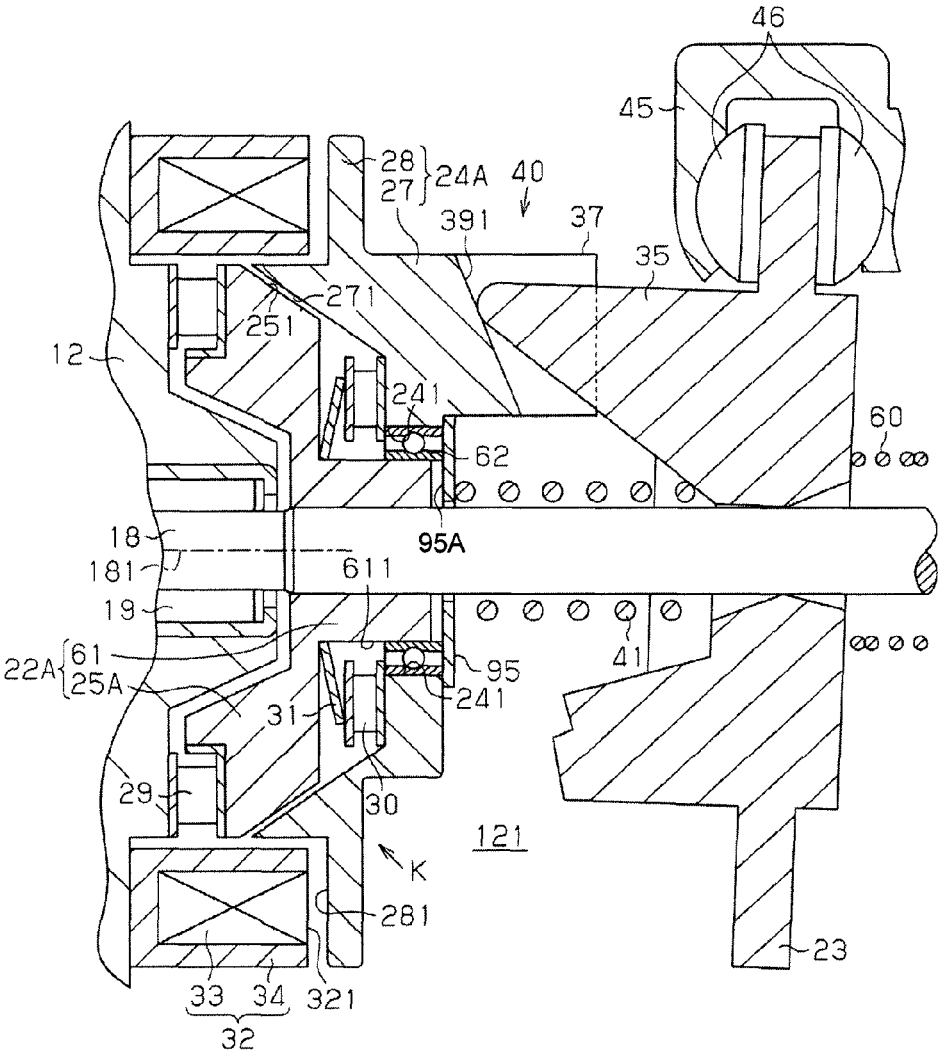
FIG. 34 is a partially enlarged sectional view of a swash plate of a variable displacement compressor according to a nineteenth embodiment of the present invention, showing a state where the swash plate is placed at the minimum inclination angle position.
Figure 35:
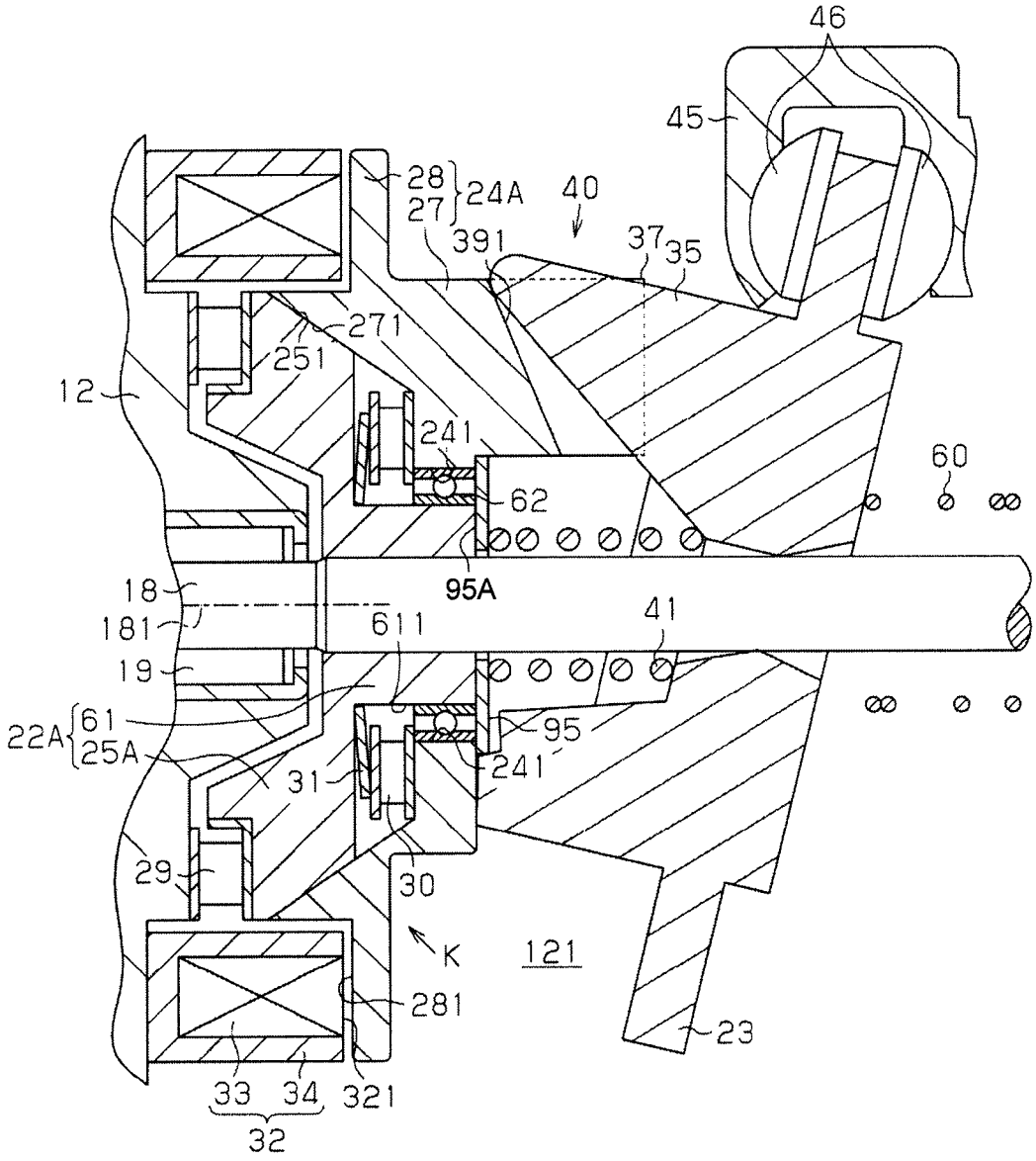
FIG. 35 is a partially enlarged sectional view of the swash plate of the variable displacement compressor of FIG. 34, showing a state where the swash plate is placed at the maximum inclination angle position.

The following will describe the nineteenth embodiment of the present invention with reference to FIGS. 34 and 35. The same reference numerals are used for the common elements or components in the third and nineteenth embodiments, and the description of such elements or components for the nineteenth embodiment will be omitted.

Referring to FIG. 34, an annular pressing member 95 is interposed between the second rotor 24A and the inclination-angle reduction spring 41 so as to surround the rotary shaft 18. A gap is formed between the rotary shaft 18 and the inner peripheral surface of the pressing member 95. The pressing member 95 is movable in the direction of the axis 181. The pressing member 95 has a front surface 95A that faces the second rotor 24A and is in contact with the second rotor 24A and the rolling bearing 62. The pressing member 95 prevents the rolling bearing 62 from falling into the crank chamber 121.

When the swash plate 23 is at the minimum inclination angle position and the cone clutch K is disengaged (or the solenoid 32 is deenergized), the inclination-angle reduction spring 41 does not urge the pressing member 95 toward the second rotor 24A, but urges the swash plate 23 in the direction that causes the inclination angle of the swash plate 23 to be decreased. The front surface 95A of the pressing member 95 is then spaced from the cylindrical guide portion 61.

Referring to FIG. 35, when the solenoid 32 is energized to engage the cone clutch K, the second rotor 24A and the swash plate 23 are rotated integrally with the first rotor 22A thereby to increase the inclination angle of the swash plate 23. When the inclination angle of the swash plate 23 is increased, the swash plate 23 presses the inclination-angle reduction spring 41 against the pressing member 95 thereby to press the pressing member 95 against the second rotor 24A. When the pressing member 95 presses the second rotor 24A and the rolling bearing 62, the second rotor 24A is urged toward the first rotor 22A thereby to increase the transmission torque between the conical surfaces 251 and 271. In the present embodiment, the inclination-angle reduction spring 41 serves as an urging member. In addition, the inclination-angle reduction spring 41 and the pressing member 95 cooperate to form an urging device that urges the second rotor 24A toward the first rotor 22A. The front surface 95A of the pressing member 95 is in contact with the second rotor 24A. The inclination-angle reduction spring 41 and the pressing member 95 also serve as a distance restriction device that restricts the distance between the first rotor 22A and the second rotor 24A in the direction of the axis 181.

Figure 36:
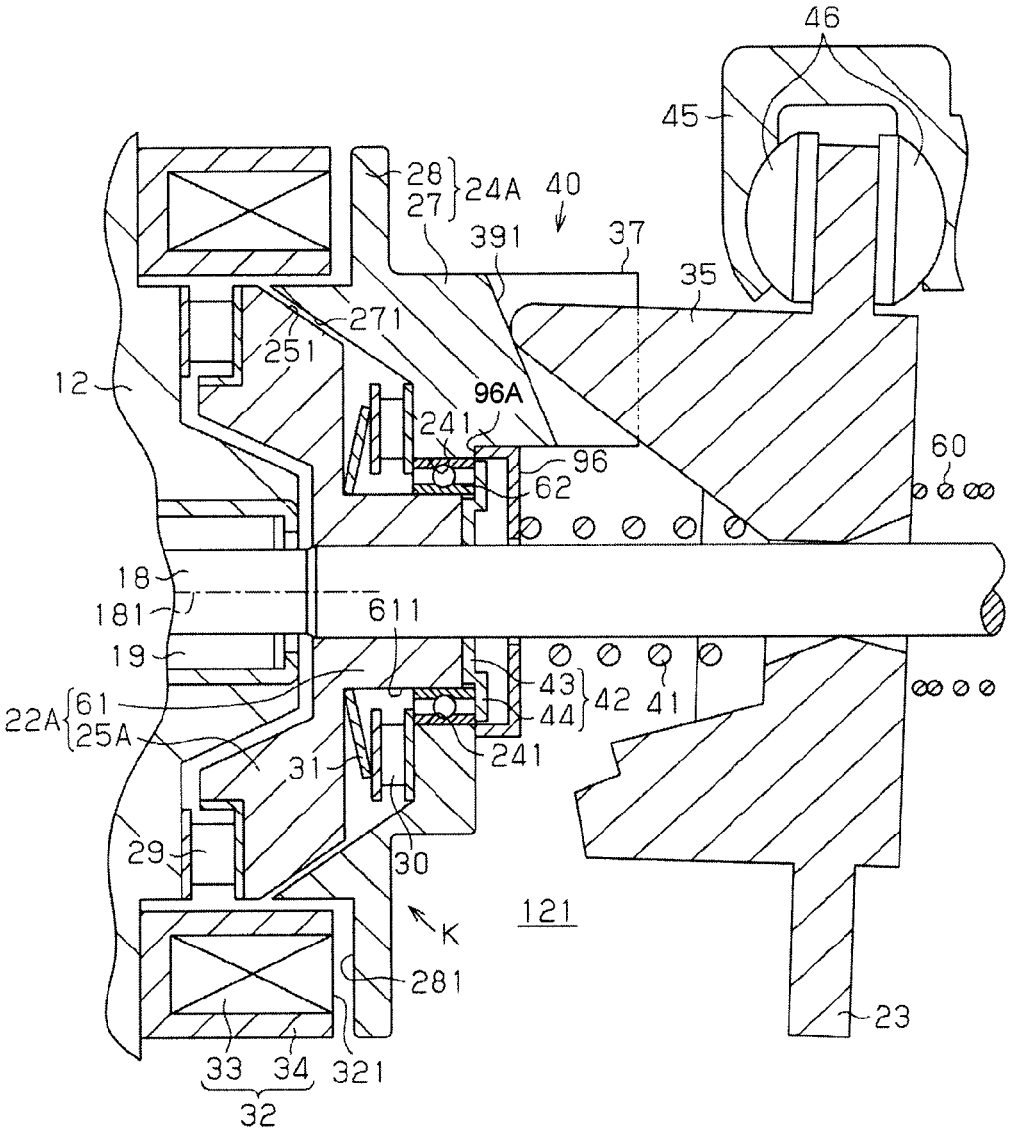
FIG. 36 is a partially enlarged sectional view of a swash plate of a variable displacement compressor according to a twentieth embodiment of the present invention, showing a state where the swash plate is placed at the minimum inclination angle position.
Figure 37:
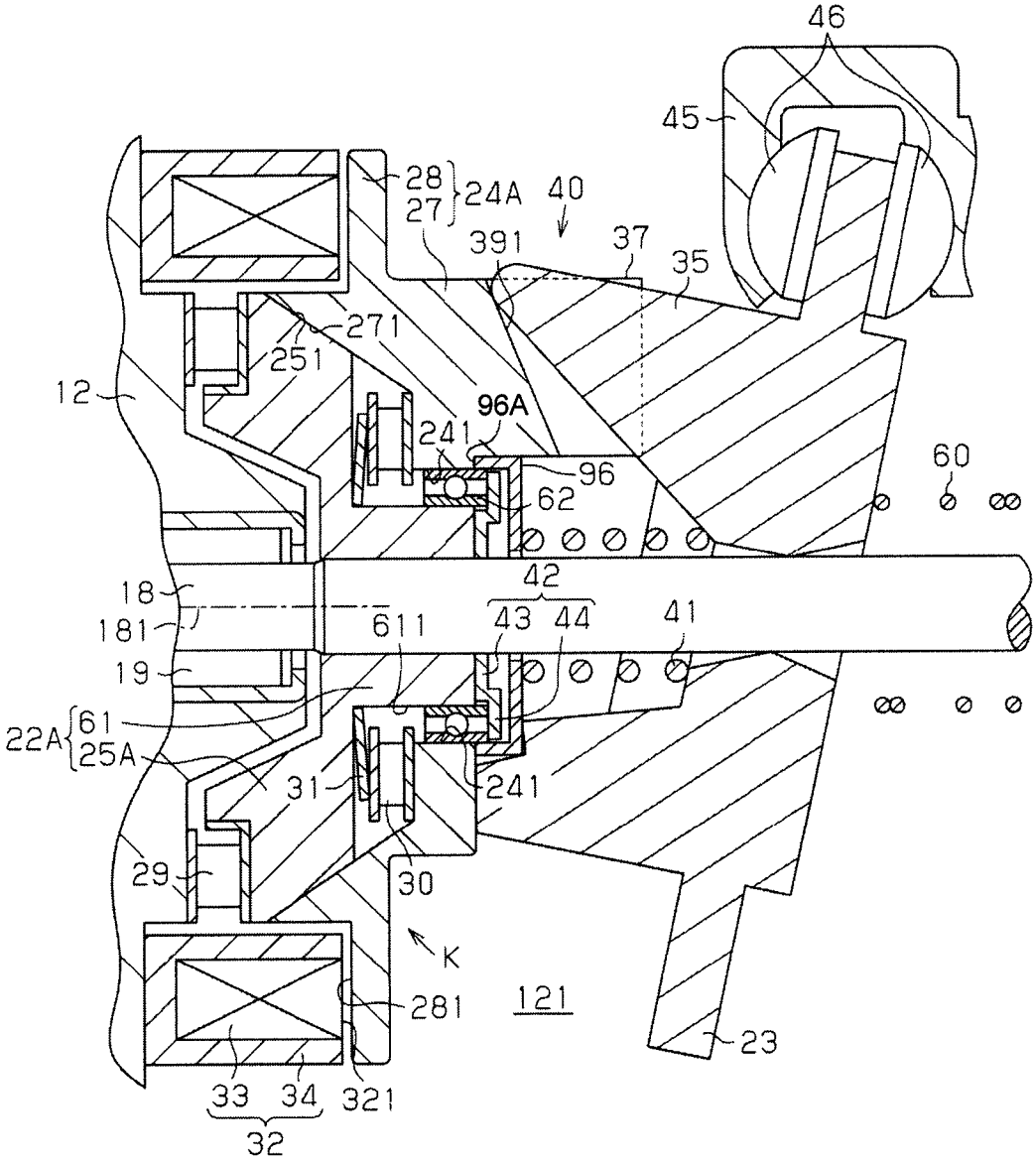
FIG. 37 is a partially enlarged sectional view of the swash plate of the variable displacement compressor of FIG. 36, showing a state where the swash plate is placed at the maximum inclination angle position.

The following will describe the twentieth embodiment of the present invention with reference to FIGS. 36 and 37. The same reference numerals are used for the common elements or components in the third and twentieth embodiments, and the description of such elements or components for the twentieth embodiment will be omitted.

Referring to FIG. 36, an annular pressing member 96 is interposed between the stop 42 and the inclination-angle reduction spring 41 so as to surround the rotary shaft 18. A gap is formed between the rotary shaft 18 and the inner peripheral surface of the pressing member 96. The pressing member 96 is movable in the direction of the axis 181. The pressing member 96 has an annular end surface 96A that faces the second rotor 24A and is in contact with the second rotor 24A. The stop 42 is disposed in the pressing member 96.

Referring to FIG. 37, when the solenoid 32 is energized to engage the cone clutch K, the second rotor 24A and the swash plate 23 are rotated integrally with the first rotor 22A thereby to increase the inclination angle of the swash plate 23. With an increase of the inclination angle of the swash plate 23, the inclination-angle reduction spring 41 is pressed against the pressing member 96 thereby to press the pressing member 96 against the second rotor 24A. When the pressing member 96 presses the second rotor 24A, the second rotor 24A is urged toward the first rotor 22A thereby to increase the transmission torque between the conical surfaces 251 and 271. In the present embodiment, the inclination-angle reduction spring 41 serves as an urging member. In addition, the inclination-angle reduction spring 41 and the pressing member 96 cooperate to form an urging device that urges the second rotor 24A toward the first rotor 22A.

Figure 38:
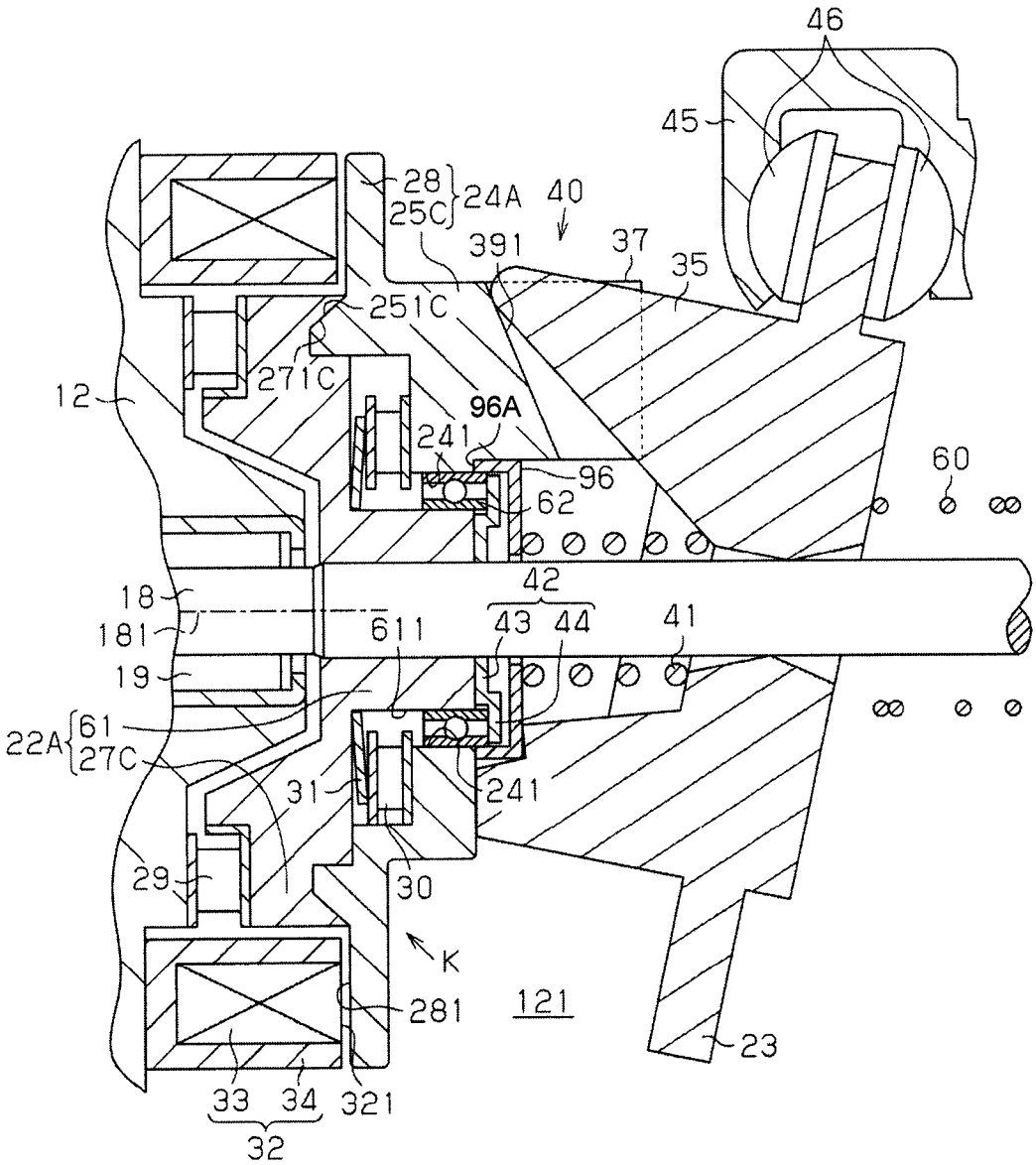
FIG. 38 is a partially enlarged sectional view of a swash plate of a variable displacement compressor according to a twenty-first embodiment of the present invention, showing a state where the swash plate is placed at the maximum inclination angle position.

The following will describe the twenty-first embodiment of the present invention with reference to FIG. 38. The same reference numerals are used for the common elements or components in the twentieth and twenty-first embodiments, and the description of such elements or components for the twenty-first embodiment will be omitted.

Referring to FIG. 38, the first rotor 22A has a female cone portion 27C. The female cone portion 27C has a conical surface 271C that surrounds the axis 181. The second rotor 24A has a male cone portion 25C that is connectable to and disconnectable from the female cone portion 27C. The male cone portion 25C has a conical surface 251C that surrounds the axis 181. The conical surfaces 271C and 251C are contactable in a face-to-face manner. Thus, the male cone portion 25C of the second rotor 24A and the female cone portion 27C of the first rotor 22A may cooperate to form the cone clutch K.

The present invention has been described in the context of the above embodiments, but it is not limited to those embodiments. It is obvious to those skilled in the art that the invention may be practiced in various manners as exemplified below.

A coil spring may be used as the spring member instead of the disc spring 31 interposed between the first rotor and the second rotor.

Figure 39:
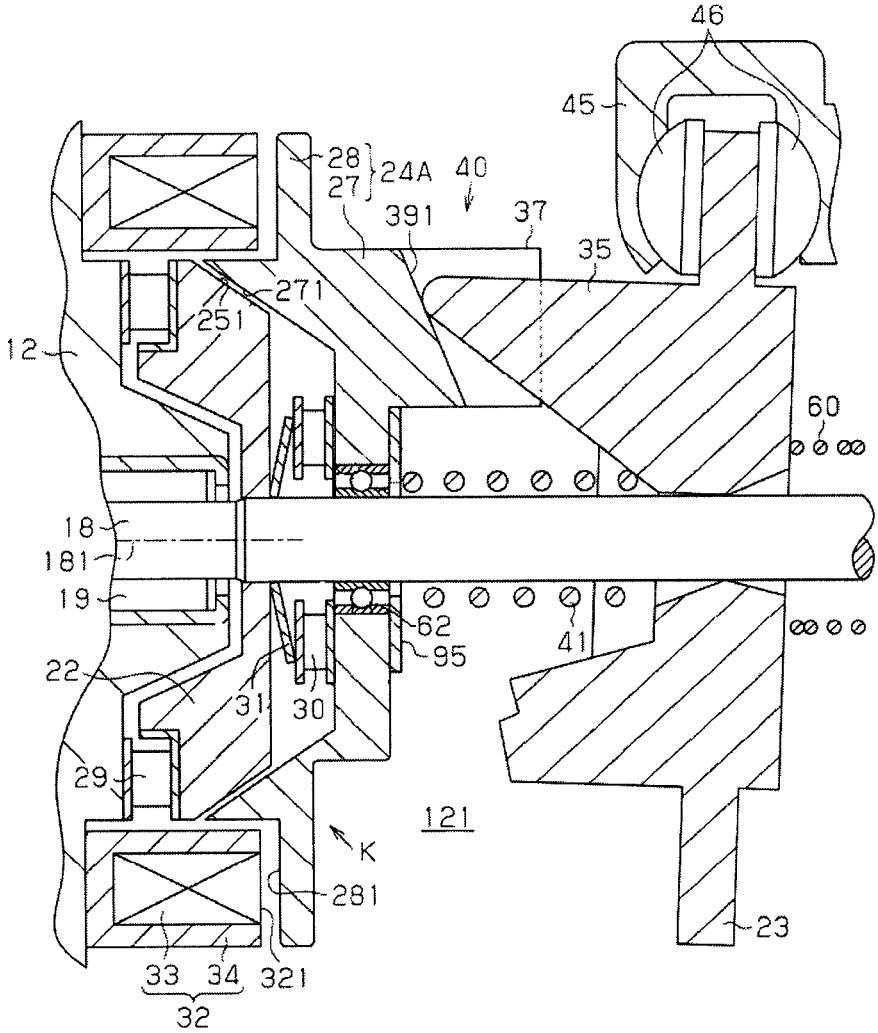
FIG. 39 is a partially enlarged sectional view of a swash plate of a variable displacement compressor according to a modification of the third embodiment of the present invention, showing a state where the swash plate is placed at the minimum inclination angle position.

In the third embodiment, the guide may be interposed between the rotary shaft 18 and the second rotor 24A as shown in FIG. 39.

In the fifth embodiment, the first lubrication groove 65 and the second lubrication groove 66 may be formed only in the coil cover 64.

In the sixth embodiment, the first annular lubrication groove 67 and the second annular lubrication groove 68 may be formed in the coil cover 64. Although in the sixth embodiment the coil holder 34 has a single first annular lubrication groove 67 and a single second annular lubrication groove 68, each of the coil cover 64 and the coil holder 34 may have a plurality of first annular lubrication grooves 67 and a plurality of second annular lubrication grooves 68.

In the sixth embodiment, the first annular lubrication groove 67 may be dispensed with.

In the tenth embodiment, the whole surface 281 of the attraction receiving portion 28 that faces the solenoid 32 may be formed by an inclined surface such as the inclined portion 74.

In the twelfth embodiment, either one of the paired grooves 80 may be dispensed with.

In the first embodiment, any wear-resistant surface treatment may be applied to the conical surfaces 251 and 271.

A friction material may be used for at least one of the conical surfaces 251 and 271. The use of the friction material improves the transmission of torque in the engaged cone clutch K.

Any member having a high wear resistance may be fitted on the male cone portion 25 thereby to form the conical surface 251.

Any member having a high wear resistance may be fitted on the female cone portion 27 thereby to form the conical surface 271.

The arms 35 and 36 of the swash plate 23 may be made of a non-magnetic material so as to prevent the magnetic flux from leaking from the attraction receiving portion 28 to the swash plate 23.

In a modification of the thirteenth embodiment, a first discharge pressure, a first suction pressure or a first temperature (or blowoff temperature) of the outside air near the evaporator 52 when the swash plate 23 is at the minimum inclination angle position may be detected. Additionally, a second discharge pressure, a second suction pressure or a second temperature (or blowoff temperature) of the outside air near the evaporator 52 after the energization of the solenoid 32 is started may be detected. It may be so controlled that the solenoid 32 is deenergized when the value of change between the first discharge pressure and the second discharge pressure reaches a preset reference value. Alternatively, the solenoid 32 may be deenergized when the value of change between the first suction pressure and the second suction pressure reaches a preset reference value. Further alternatively, the solenoid 32 may be deenergized when the value of change between the first temperature and the second temperature reaches a preset reference value. The outside air temperature near the evaporator 52 is an element that reflects the pressure of refrigerant. The above-mentioned value of change of the discharge pressure, the suction pressure or the outside air temperature reflects the pressure differential between the discharge pressure and the suction pressure reasonably.

The male cone portion 25 may be made of a non-magnetic material.

In the seventeenth embodiment, the disc spring 91 may be positioned within an angular range $\beta$ ($<\alpha$) around the axis 181 that ranges between the top-dead-center corresponding position 79 and a position angularly spaced from the top-dead-center corresponding position 79 at a predetermined angle 13 in the suction-stroke corresponding region 77.

In the seventeenth embodiment, a coil spring may be used instead of the disc spring 91.

In the eighteenth embodiment, the disc spring 31 may be made of a magnetic material.

In the nineteenth and twentieth embodiments, the urging device including the inclination-angle reduction spring 41 and the pressing member 95 or 96 may be configured otherwise.

What is claimed is:

1. A swash plate type variable displacement compressor comprising:

a rotary shaft;

a swash plate rotated by driving force of the rotary shaft, the swash plate being inclinable at a variable inclination angle;

a plurality of pistons engaged with the swash plate, the pistons being reciprocable in accordance with the rotation of the swash plate so that a length of stroke of each piston is varied depending on the inclination angle of the swash plate;

a first rotor connected to the rotary shaft for rotation therewith;

a second rotor transmitting the rotation of the first rotor to the swash plate;

a solenoid producing electromagnetic force that acts on the first rotor or the second rotor so that the first rotor and the second rotor move toward each other; and a cone clutch engageable by energization of the solenoid, the cone clutch having a male cone portion and a female cone portion, the male cone portion having a conical surface provided on one of the first rotor and the second rotor, the female cone portion having a conical surface provided on the other of the first rotor and the second rotor, the conical surface of the female cone portion being connectable to and disconnectable from the conical surface of the male cone portion.

2. The swash plate type variable displacement compressor according to claim 1, wherein the second rotor is interposed between the swash plate and the first rotor, the conical surface of the male cone portion being provided on the first rotor, the conical surface of the female cone portion being provided on the second rotor, the solenoid being formed in an annular shape, the first rotor being located radially inward of the solenoid as viewed in a direction of an axis of the rotary shaft.

3. The swash plate type variable displacement compressor according to claim 1, wherein a distance restriction device is provided for restricting a distance between the first rotor and the second rotor in a direction of an axis of the rotary shaft.

4. The swash plate type variable displacement compressor according to claim 3, wherein an inclination-angle reduction spring is interposed between the first rotor and the swash plate for urging the swash plate in a direction that causes the inclination angle of the swash plate to be reduced, wherein the distance restriction device is a stop interposed between the inclination-angle reduction spring and the first rotor.

5. The swash plate type variable displacement compressor according to claim 4, wherein the stop is a plain bearing.

6. The swash plate type variable displacement compressor according to claim 1, wherein the first rotor is formed in an annular shape to have an axial hole through which the rotary shaft is fixedly fitted, the conical surface of the male cone portion being provided on the first rotor.

7. The swash plate type variable displacement compressor according to claim 1, wherein a spacer is provided for spacing the conical surface of the male cone portion and the conical surface of the female cone portion from each other.

8. The swash plate type variable displacement compressor according to claim 7, wherein the spacer is a spring member interposed between the first rotor and the second rotor.

9. The swash plate type variable displacement compressor according to claim 8, wherein the spring member is a disc spring that surrounds an axis of the rotary shaft.

10. The swash plate type variable displacement compressor according to claim 8, wherein the spring member is disposed in a compression-stroke corresponding region.

11. The swash plate type variable displacement compressor according to claim 8, wherein a thrust bearing is interposed between the spring member and the second rotor or between the spring member and the first rotor.

12. The swash plate type variable displacement compressor according to claim 11, wherein the thrust bearing is a rolling bearing.

13. The swash plate type variable displacement compressor according to claim 8, wherein when a minimum top clearance of each piston that is formed when the swash plate is at a maximum inclination angle position is represented by $T_{cmin}$, a top clearance of each piston that is formed when the swash plate is at a minimum inclination angle position is represented by $\Delta T_c+T_{cmin}$, and an amount of elastic deformation of the spring member when the cone clutch is engaged is represented by $\eta$, $\Delta T_c$ meets the relational expression $T_{cmin}+\Delta T_c \geq \eta$.

14. The swash plate type variable displacement compressor according to claim 1, wherein a guide is interposed between the first rotor or the rotary shaft and the second rotor, the guide including a cylindrical guide portion and a cylindrical surface, the cylindrical guide portion being provided in one of the first rotor or the rotary shaft and the second rotor, the cylindrical surface being provided on the other of the first rotor or the rotary shaft and the second rotor, the cylindrical surface being rotatably and slidably fitted into or onto the cylindrical guide portion.

15. The swash plate type variable displacement compressor according to claim 14, wherein a radial bearing is interposed between the cylindrical guide portion and the cylindrical surface.

16. The swash plate type variable displacement compressor according to claim 15, wherein the radial bearing is a rolling bearing.

17. The swash plate type variable displacement compressor according to claim 1, wherein the solenoid has an annular surface that faces the second rotor, a lubrication groove being formed radially across the annular surface.

18. The swash plate type variable displacement compressor according to claim 17, wherein the lubrication groove includes a first lubrication groove below an axis of the rotary shaft, the first lubrication groove communicating at an outer periphery of the annular surface with a radially outer region of the solenoid, the first lubrication groove being located so as to be immersed in a lubricating oil accumulated in a crank chamber in which the swash plate is disposed.

19. The swash plate type variable displacement compressor according to claim 17, wherein the lubrication groove includes a second lubrication groove above an axis of the rotary shaft, the second lubrication groove communicating at an inner periphery of the annular surface with a radially inner region of the solenoid.

20. The swash plate type variable displacement compressor according to claim 1, wherein the solenoid has an annular surface that faces the second rotor, a lubrication groove being formed in the annular surface so as to extend along the annular surface.

21. The swash plate type variable displacement compressor according to claim 1, wherein the second rotor is made of a magnetic material and has an attraction receiving portion that is attracted to the solenoid by energization of the solenoid, the second rotor having a flux barrier that serves to reduce flux leakage from the attraction receiving portion to the rotary shaft or the swash plate.

22. The swash plate type variable displacement compressor according to claim 21, wherein the flux barrier is a void.

23. The swash plate type variable displacement compressor according to claim 1, wherein the swash plate is connected to the second rotor via a hinge mechanism at a position that is spaced radially from an axis of the rotary shaft, the second rotor having a surface that faces the solenoid, the surface of the second rotor having a inclined portion behind the hinge mechanism, the inclined portion being formed so as to be spaced from the solenoid with a radially outwardly increasing spaced distance.

24. The swash plate type variable displacement compressor according to claim 1, wherein the solenoid includes a coil and an annular coil holder that holds the coil, the coil holder having a radially outer annular end surface and a radially inner annular end surface that face the second rotor, at least one of the radially outer annular end surface and the radially inner annular end surface being tapered, the second rotor having an annular portion that faces the tapered surface of the coil holder, the annular portion of the second rotor having a surface that is tapered, the tapered surface of the annular portion of the second rotor being complementary to the tapered surface of the coil holder.

25. The swash plate type variable displacement compressor according to claim 1, wherein the solenoid includes a coil and an annular coil holder that holds the coil, the coil holder having on a radially inner annular portion thereof a first surface that faces an outer peripheral surface of the first rotor, the coil holder also having on a radially outer annular portion thereof a second surface that faces an outer peripheral surface of the second rotor, a first gap being formed between the outer peripheral surface of the first rotor and the first surface so as to form a path of magnetic flux that flows in a radial direction of the rotary shaft, a second gap being formed between the outer peripheral surface of the second rotor and the second surface so as to form a path of magnetic flux that flows in the radial direction of the rotary shaft, magnetic flux developed in the coil holder by energization of the solenoid being flowed back to the coil holder via the second gap, the second rotor, the conical surface of the male cone portion, the conical surface of the female cone portion, the first rotor and the first gap thereby to form a magnetic circuit.

26. The swash plate type variable displacement compressor according to claim 1, wherein a groove is formed in the conical surface of the female cone portion so as to extend across the conical surface of the female cone portion.

27. The swash plate type variable displacement compressor according to claim 26, wherein the groove is formed within an angular range around an axis of the rotary shaft, the angular range covering an angular range around the axis excepting the angular range ranging from a top-dead-center corresponding position to a position that is spaced at a predetermined angle in a compression-stroke corresponding region.

28. The swash plate type variable displacement compressor according to claim 1, wherein the solenoid and the cone clutch cooperate to form an electromagnetic clutch that is incorporated in a compressor housing of the swash plate type variable displacement compressor.

29. The swash plate type variable displacement compressor according to claim 1, wherein an urging device is provided for urging the second rotor toward the first rotor with the cone clutch engaged by energization of the solenoid.

30. The swash plate type variable displacement compressor according to claim 29, wherein the urging device includes a pressing member and an urging member, the pressing member being movable in a direction of an axis of the rotary shaft between the second rotor and the swash plate, the urging member being interposed between the pressing member and the swash plate, wherein when the inclination angle of the swash plate is increased, the swash plate presses the urging member against the pressing member thereby to urge the pressing member against the second rotor.

31. A method of controlling a solenoid of a swash plate type variable displacement compressor having a cone clutch engageable by energization of the solenoid, comprising the steps of:

starting passing an electric current through the solenoid;

detecting a differential pressure between a discharge pressure and a suction pressure after the step of starting passing the electric current through the solenoid; and stopping passing the electric current through the solenoid if the differential pressure reaches a preset differential-pressure reference value.

32. A method of controlling a solenoid of a swash plate type variable displacement compressor having a swash plate and a cone clutch, the swash plate being inclinable at a variable inclination angle, the cone clutch being engageable by energization of the solenoid, comprising the steps of:

detecting a first pressure of a refrigerant or a first element that reflects the first pressure of the refrigerant when the swash plate is at a minimum inclination angle position;

starting passing an electric current through the solenoid;

detecting a second pressure of the refrigerant or a second element that reflects the second pressure of the refrigerant after the step of starting passing the electric current through the solenoid; and stopping passing the electric current through the solenoid if a value of change between the first pressure and the second pressure reaches a preset reference value or if a value of change between the first element and the second element reaches a preset reference value.

* * * * *